US005437394A

United States Patent [19]

Ruck

[11] Patent Number: 5,437,394

[45] Date of Patent: Aug. 1, 1995

[54] VISCOUS LIQUID DISPENSER

[76] Inventor: Wolf E. Ruck, 1720 Lincolnshire Blvd., Mississauga, Ontario, Canada, L5E 2S7

[21] Appl. No.: 948,649

[22] Filed: Sep. 23, 1992

[51] Int. Cl.[6] ..... B65D 35/54; B65D 83/00

[52] U.S. Cl. ..... 222/96; 222/93; 222/181.2

[58] Field of Search ..... 222/93, 96, 105, 181, 222/185, 207, 214

[56] References Cited

U.S. PATENT DOCUMENTS

| | | | |
|---|---|---|---|
| 3,232,496 | 2/1966 | Rockwell, Jr. et al. | 222/214 X |
| 4,258,865 | 3/1981 | Vahl et al. | 222/214 X |
| 4,463,876 | 8/1984 | Swallert | 222/96 X |
| 4,564,127 | 1/1986 | Garabedian et al. | 222/96 |
| 4,570,827 | 2/1986 | Roggenburg, Jr. et al. . | |
| 4,778,085 | 10/1988 | Bush et al. | 222/214 X |
| 4,804,117 | 2/1989 | Rudick | 222/214 |
| 4,830,227 | 5/1989 | Ball et al. | 222/214 X |
| 4,932,562 | 6/1990 | Christine | 222/96 |
| 4,961,508 | 10/1990 | Weimer et al. | 222/214 X |
| 5,115,945 | 5/1992 | Ruck | 222/96 |
| 5,174,476 | 12/1992 | Steiner et al. | 222/181 |

*Primary Examiner*—Andres Kashnikow
*Assistant Examiner*—Lesley D. Morris

[57] ABSTRACT

A viscous material dispenser (for liquid soap and the like) comprises a plunger with a roller connected to a flexible arm and a reservoir in fluid communication with a nozzle retained in a nozzle housing. Depressing the plunger pinches the nozzle closed between the roller and the nozzle housing and bends the flexible arm as the roller progresses along the length of the nozzle in the nozzle housing. Depressing the plunger also opens the nozzle exiting from the bottom of the reservoir. In one embodiment the reservoir is in fluid communication with an air chamber. Depressing the plunger increases the pressure in the air chamber and this pressurized air is conducted through a duct into the reservoir. The duct terminates in a portion which turns back on the remainder of the duct and this portion incorporates a one-way non-return valve so that pressure in the reservoir may be built up with consecutive strokes of the plunger due to the non-return valve. When air is pumped through the duct, a bubble of air is trapped between the valve and the mouth of the duct which prevents fouling of the valve by the viscous material. The reservoir may receive a sac of viscous material comprising a sac nozzle with a rigid extension with which the sac nozzle is threaded into and pulled through the nozzle in the nozzle housing.

45 Claims, 9 Drawing Sheets

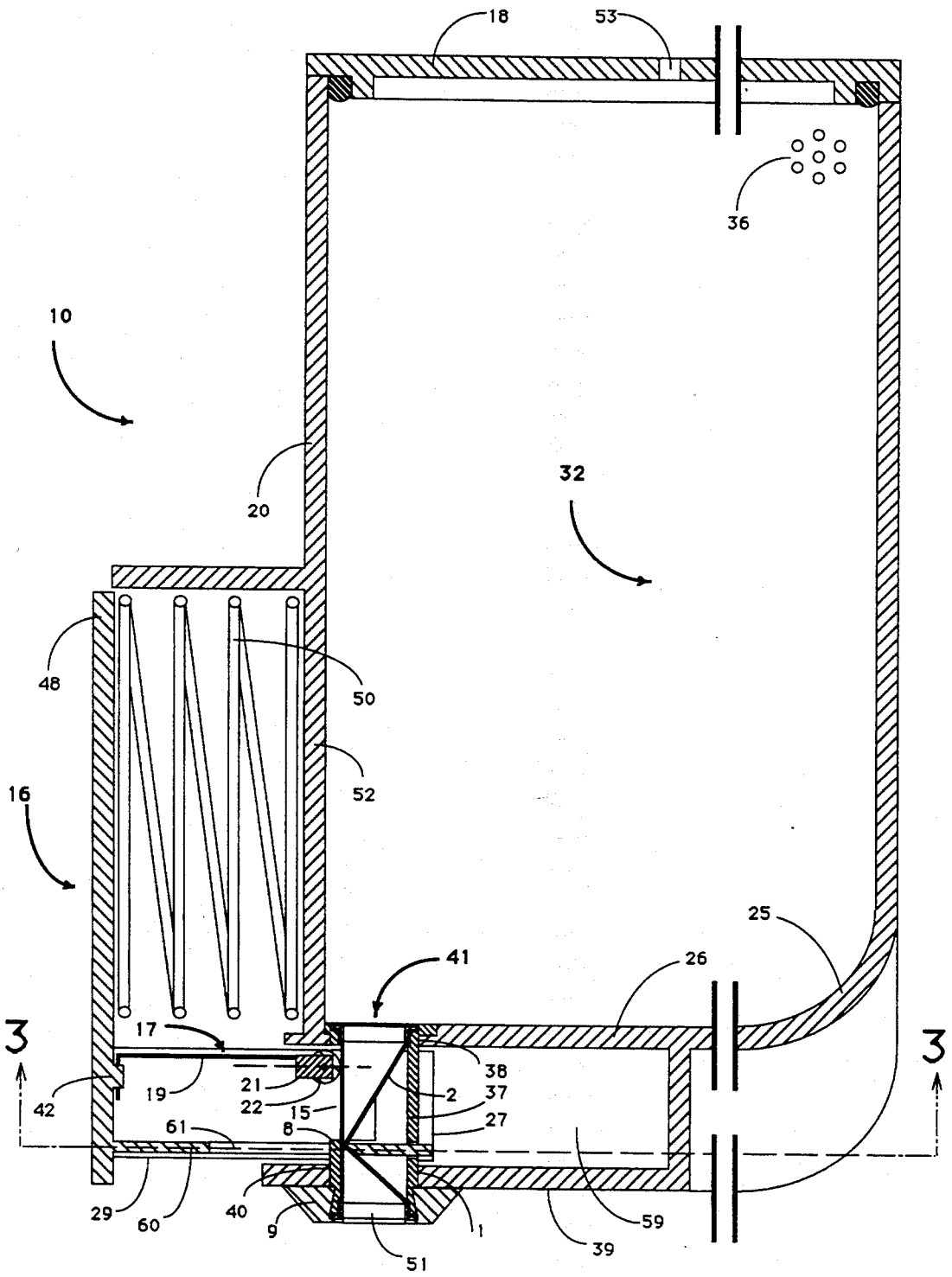
FIG. 1.a

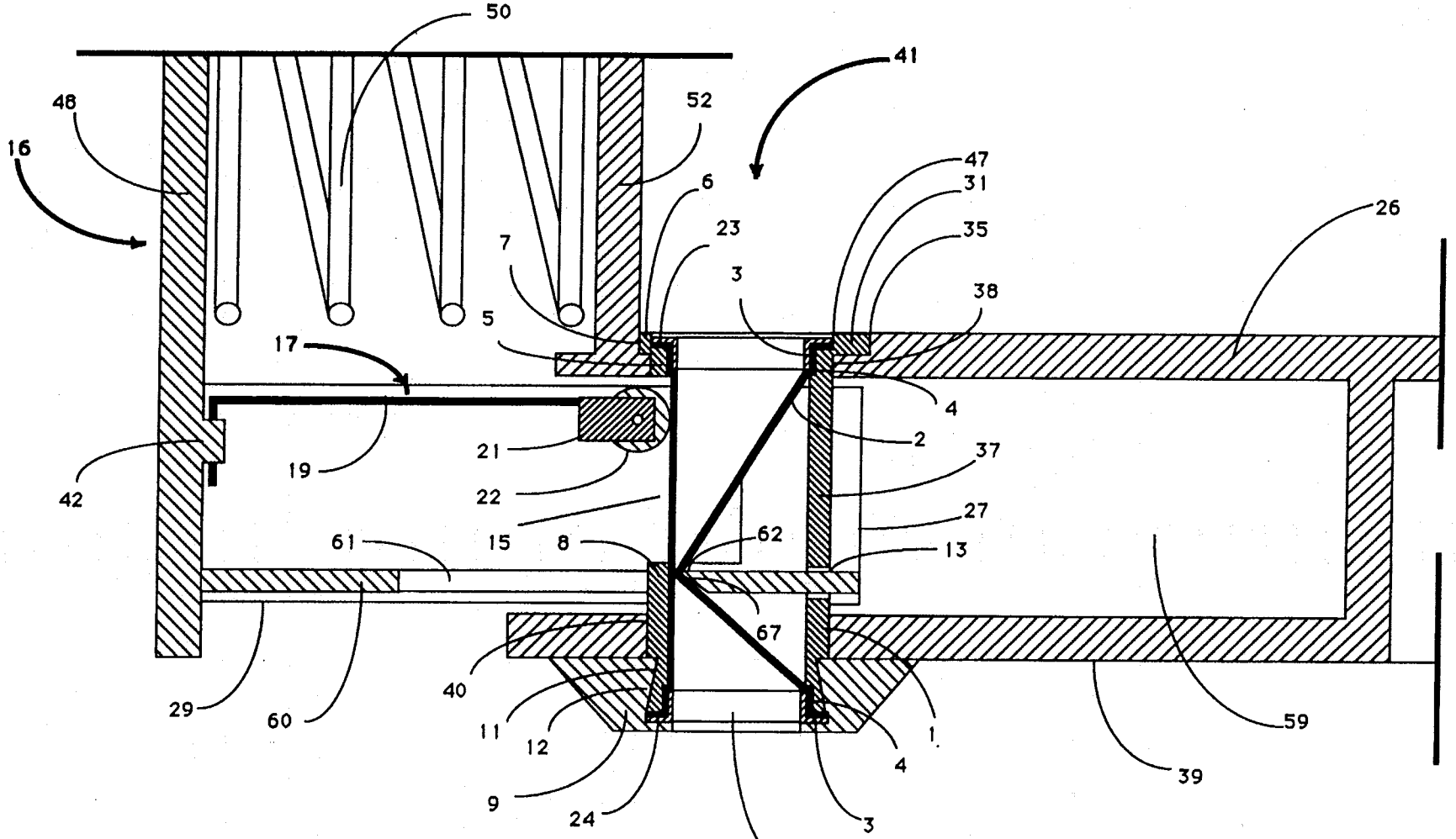
FIG. 1.b

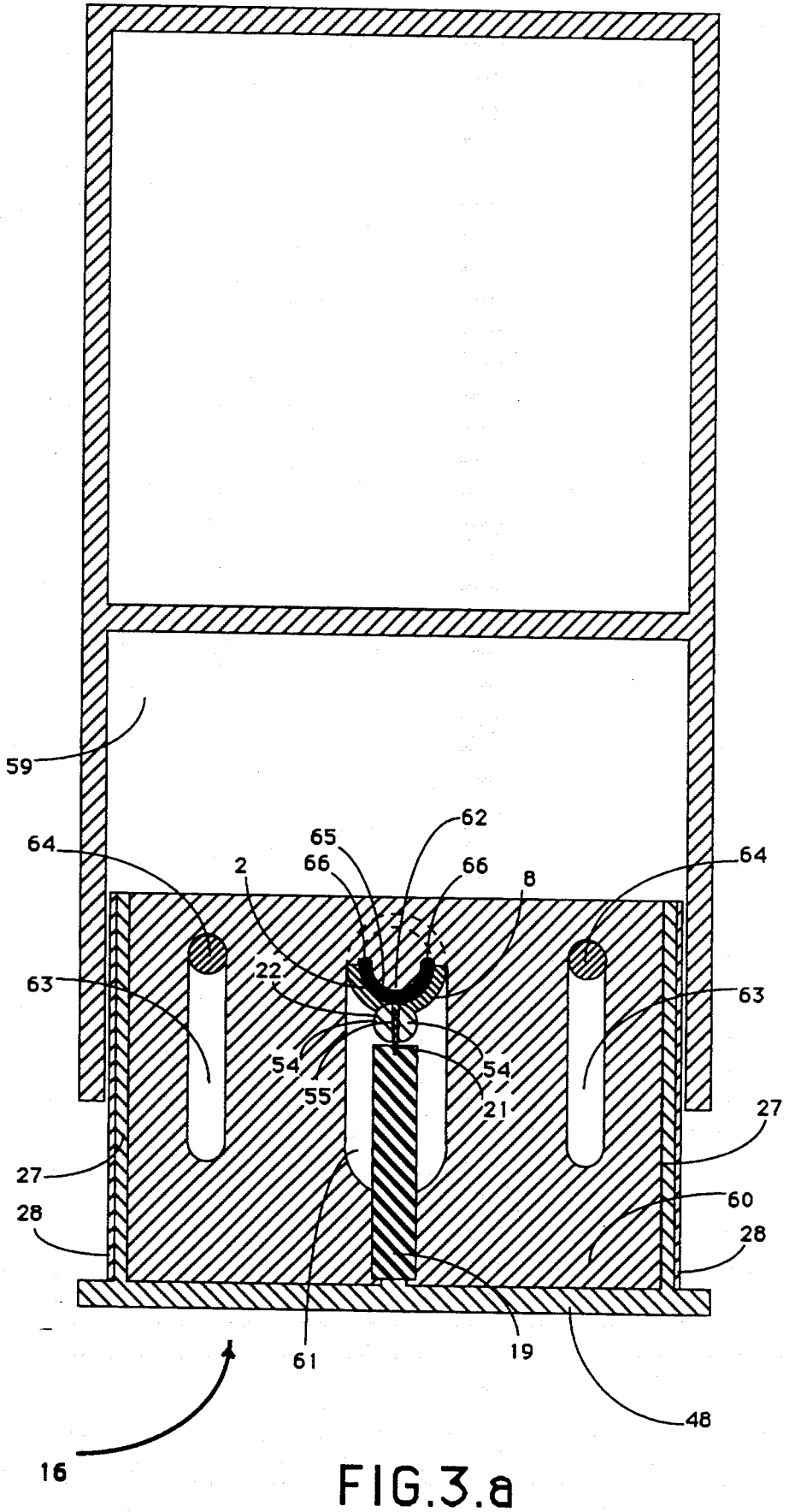
FIG.3.a

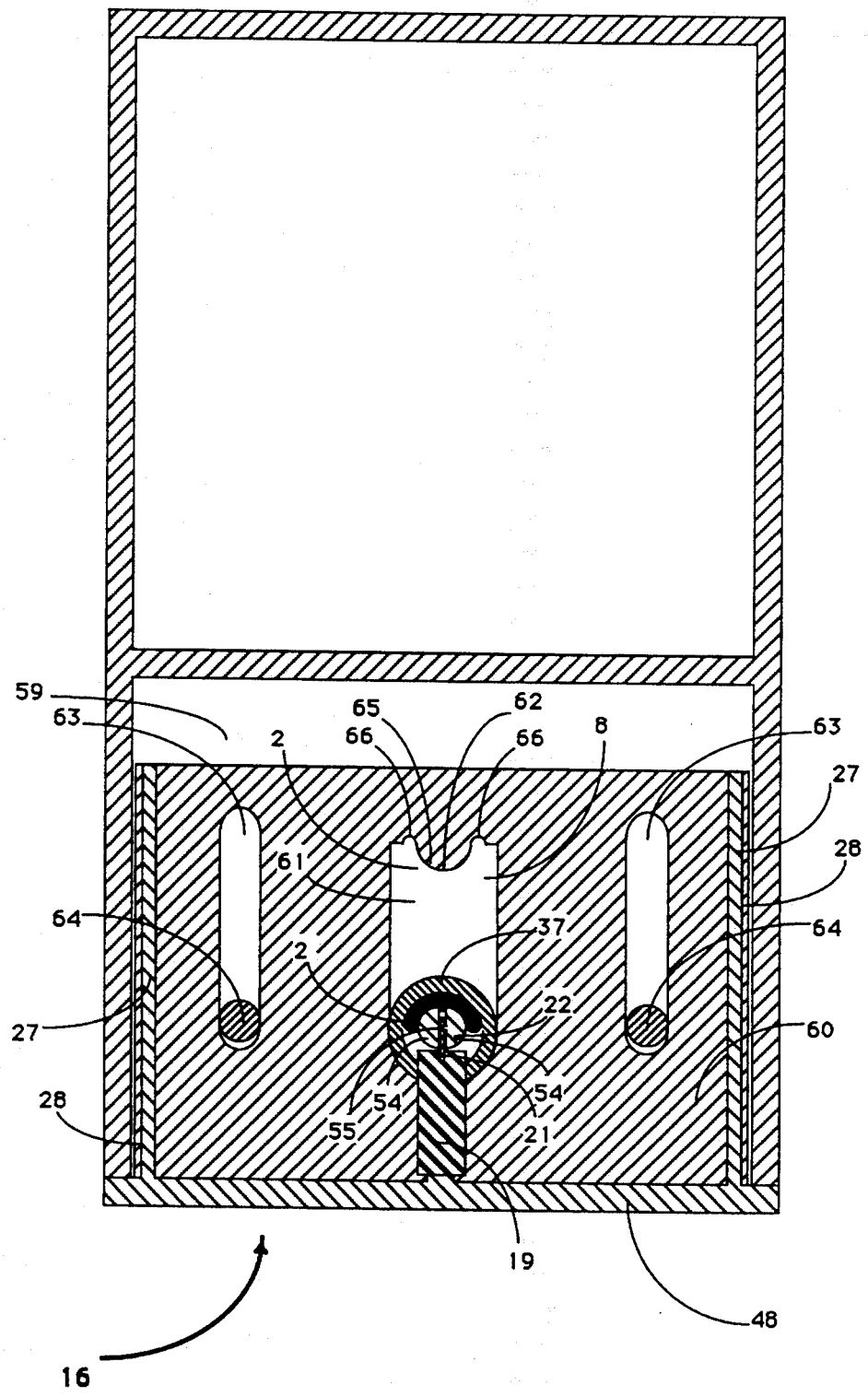
FIG.3.b

VISCOUS LIQUID DISPENSER

BACKGROUND OF THE INVENTION

This invention relates generally to an improved dispensing means for discharging a viscous material, and more particularly to such dispensing means having a feature which permits dispensing of viscous material both through a nozzle and through a sac nozzle inserted through such nozzle, as well as a feature which facilitates dispensing of highly viscous material through such nozzle and such sac nozzle inserted through such nozzle, controls the quantity of viscous material ejected through such nozzle and such sac nozzle inserted through such nozzle, reduces dripping of less viscous, watery material through such nozzle and such sac nozzle inserted through such nozzle, and minimizes the possibility of introducing contaminants from the outside through such nozzle and such sac nozzle inserted through such nozzle.

Product dispensers generally of the type described herein, as including a reservoir having a basal dispensing opening; manual urging means actuatable to pressurize viscous material in said basal dispensing opening; and a vent for venting said reservoir prior to actuation of said manual urging means are known as having means provided for dispensing viscous material contained in a sac contained inside said reservoir, through a nozzle in said basal dispensing opening.

For example, dispensing devices having means provided for dispensing viscous material contained in a sac inside a reservoir through a resilient, tubular nozzle in the bottom wall of the sac are well known. A manual plunger may be actuated to exert mechanical pressure on a portion of said resilient, tubular nozzle, thus dispensing viscous material contained in said nozzle portion.

While these nozzles have generally performed satisfactorily, they are not without their shortcomings. For example, the resilient, tubular nozzle must be affixed to the sac in a substantially leak-proof manner. Since the sac and nozzle are generally made of different materials, additional time and material is expended to achieve these intended functions. Moreover, upon releasing the manual plunger, viscous material contained in the sac is urged to flow into the nozzle portion solely by the force of gravity and the minor pressure differential created in the resilient nozzle portion as the nozzle portion rebounds from a flattened to an tubular shape. For highly viscous material, these forces may be insufficient to fill the nozzle portion before subsequent actuation of the manual plunger, thus reducing the quantity of viscous material dispensed through the nozzle. Furthermore, no means are provided to prevent leakage of less viscous, watery materials through the nozzle when the manual plunger is unactuated. Additionally, the manual plunger exerts even mechanical pressure along the resilient tubular nozzle portion when the plunger is actuated so that the pressure differential between the pressure of viscous material at the entrance of the nozzle portion and the ambient air pressure at the exit of the nozzle portion urges the viscous material to dispense through the exit of the nozzle portion. However, when the pressure of viscous material at the entrance of the nozzle portion resulting from the force of gravity acting on the viscous material is reduced as the viscous material remaining in the sac is depleted, or when the material at the exit of the nozzle portion is more viscous as a result of drying, the pressure differential between the pressure of viscous material at the entrance of the nozzle portion and the ambient air pressure at the exit of the nozzle portion may urge the viscous material to re-enter the sac through the entrance of the nozzle portion when the manual plunger is actuated, and the resultant backflow may reduce, if not eliminate, the quantity of viscous material dispensed through the nozzle.

Other product dispensers generally of the type described herein, as including a reservoir having a basal dispensing opening; an air chamber; manual pumping means actuatable to pressurize air in said air chamber; venting means for venting said air chamber prior to actuation of said pumping means; means for communicating pressurized air from said air chamber to said reservoir; and means for selectively blocking the dispensing of material are known as having means provided for dispensing viscous material contained in said reservoir through a nozzle in said basal dispensing opening, or for dispensing viscous material contained in a sac in said reservoir, through a sac nozzle in said basal dispensing opening.

U.S. Pat. No. 5,115,945 discloses a dispensing device having means provided for dispensing viscous material contained in a reservoir through a resilient, tubular nozzle which is held in place in a basal dispensing opening by internal and external snap rings. Such means also provides for dispensing viscous material contained in a sac inside the reservoir through a resilient, tubular nozzle in the bottom wall of the sac which is held in place in the basal dispensing opening by internal and external snap rings. Thus, the dispensing device permits removal of the original nozzle from the basal dispensing opening and insertion of a sac incorporating a similar nozzle in the bottom wall of the sac into the reservoir, with the sac nozzle replacing the original nozzle in the basal dispensing opening.

While these nozzles have generally performed satisfactorily, they are not without their shortcomings. For example, the resilient, tubular nozzle must be affixed to the sac in a substantially leak-proof manner. Since the sac and nozzle are generally made of different materials, additional time and material is expended to achieve these intended functions. Moreover, insertion and removal of the original resilient, tubular nozzle is time-consuming and the original nozzle may get lost between uses. Furthermore, if the original nozzle or the nozzle on the sac is not properly pulled through the basal dispensing opening, or if there is a residue of reservoir material remaining around the basal dispensing opening accepting the nozzle snap rings, the seal between the nozzle and the reservoir bottom wall may not be airtight or leak-proof, reducing the efficiency of pressurizing the reservoir and making the dispensing of viscous material difficult if not impossible. In addition, highly viscous material often requires several pumps to build sufficient pressure in the reservoir to dispense the desired quantity of product through the nozzle. Moreover, the quantity of material dispensed per pumping action varies because it is a function of the pressure in the reservoir and the length of time the manual pump is held depressed. Furthermore, the nozzle remains open for as long as the manual pump is held depressed. Thus, when dispensing less viscous, watery product, dripping from the nozzle may result. Additionally, when the manual pump is held depressed, the passageway from the reservoir through the nozzle to the exterior remains open, rendering the reservoir contents susceptible to contamination introduced from the exterior through the open nozzle into the reservoir.

SUMMARY OF THE INVENTION

It is therefore an object of the present invention to provide an improved dispensing device of the type described with a view to simplifying the use of refill sacs and reducing their cost of manufacture while at the same time improving upon the efficiency and precision of operation.

Another object is to provide such a dispensing device as having a permanent nozzle in the basal dispensing opening which effects an air-tight and leak-proof seal between the nozzle and the bottom wall of the reservoir while at the same time allowing a flexible sac nozzle to be inserted through the nozzle.

A further object of this invention is to provide such a dispensing device as having a one-way ejector feature which facilitates the dispensing of highly viscous material through the nozzle and provides for the dispensing of a precise quantity of material per pump stroke.

Another object of this invention is to provide such a dispensing device as having a one-way ejector feature which reduces the dripping of less viscous, watery product from the nozzle when the manual pump remains depressed.

A further object of this invention is to provide such a dispensing device as having a one-way ejector feature which reduces the possibility of introducing contaminants from the outside into the reservoir through the nozzle when the manual pump remains depressed.

Another object of this invention is to provide such a dispensing device as having a one-way ejector feature which permits the insertion of the sac nozzle through the nozzle and the removal of the sac nozzle from the nozzle.

A further object of this invention is to provide such a dispensing device as having a one-way ejector feature which minimizes the back-flow of viscous material from the nozzle into the reservoir or from the sac nozzle into the sac when the manual plunger is depressed.

Other objects, advantages and novel features of the present invention will become more apparent from the following detailed description of the invention when taken in conjunction with the accompanying drawings.

DETAILED DESCRIPTION OF THE INVENTION

Accordingly, the present invention comprises a dispensing means for a viscous material comprising: (a) a reservoir for containing a viscous material, said reservoir having a first basal dispensing opening; (b) a slot in said reservoir, said slot having a second basal dispensing opening; (c) a nozzle housing received by said first and second basal dispensing openings in communication with said reservoir; (d) a nozzle received by said nozzle housing in fluid communication with said reservoir; (e) a manual plunger and urging means to urge said plunger to an undepressed, unactuated position; (f) a first means for selectively blocking the dispensing of material through said first and second basal dispensing openings comprising: a slider leg depending from said plunger and associated with said first and second basal dispensing openings with said leg blocking the dispensing of material when said plunger is in a first undepressed position, and said leg not blocking the dispensing of material when said plunger is depressed to a second position; said manual plunger being operatively connected to said first means for selectively blocking the dispensing of material through said first and second basal dispensing openings; whereby the force of gravity acting on viscous material contained in said reservoir pressurizes viscous material at the bottom of said reservoir so that when said reservoir contains viscous material and said nozzle is not blocked, viscous material at said second basal dispensing opening is exposed to ambient air pressure so that viscous material at the bottom of said reservoir is urged to exit through said nozzle by the pressure differential between the pressure at the bottom of said reservoir and ambient air pressure; (g) means for selectively urging and blocking the dispensing of material through said second basal dispensing opening comprising: a plunger arm depending from said plunger and associated with said first and second basal dispensing openings with said arm urging the dispensing of material through said second basal dispensing opening when said plunger is depressed from said undepressed first position to said depressed second position, and with said arm not urging the dispensing of material through said second basal dispensing opening when said plunger is in said first undepressed position, or when said plunger is in said second depressed position, or when said plunger is returning from said depressed second position to said undepressed first position; and with said arm blocking the dispensing of material through said nozzle when said plunger is in said depressed second position, and with said arm blocking the dispensing of material through said second basal dispensing opening during at least a portion of the return stroke of said plunger when said plunger is returning from said depressed second position to said undepressed first position; said manual plunger being operatively connected to said means for selectively urging and blocking the dispensing of material through said second basal dispensing opening; whereby mechanical pressure exerted on said nozzle by said plunger arm when said plunger is depressed may increase pressure in said nozzle so that viscous material contained in said nozzle is urged to exit through said second basal dispensing opening by the pressure differential between the pressure in said nozzle and ambient air pressure; and whereby, after viscous material contained in said nozzle is dispensed through said second basal dispensing opening and said plunger is released and is returning from said depressed second position to said undepressed first position, the mechanical pressure exerted on said nozzle by said plunger arm may be reduced when said plunger is returning to said undepressed first position and pressure in said nozzle may fall below ambient air pressure so that material at said second basal dispensing opening may be urged by a pressure differential to re-enter said nozzle while said nozzle is not blocked by said first selective blocking means; and whereby mechanical pressure is exerted on said nozzle by said plunger arm when said plunger is in said depressed second position so that said nozzle is pinched closed between said arm and said nozzle housing, thereby blocking the dispensing of viscous material through said nozzle; and whereby mechanical pressure is maintained on said nozzle by said arm when said plunger is released and is returning from said depressed second position to said undepressed first position so that said nozzle remains pinched closed between said arm and said nozzle housing during at least a portion of the return stroke of said plunger when said plunger is returning from said depressed second position to said undepressed first position, thereby blocking the dispensing of viscous material through said nozzle; and whereby viscous material contained in said reservoir may be blocked from entering said nozzle by said second selective blocking means when said plunger is in said depressed second position and during at least a portion of the return stroke of said plunger when said plunger is returning from said depressed second position to said undepressed first position, and free to enter said nozzle when said plunger is in said undepressed first position; (h) venting means for venting said reservoir to ambient air pressure prior to actuation of said manual plunger means, said venting means comprising an opening to allow ambient air to enter said reservoir when the pressure in said reservoir is at or below ambient pressure.

In another aspect, the present invention comprises a dispensing means for a viscous material comprising: (a) a reservoir for containing a viscous material, said reservoir having a first basal dispensing opening; (b) an air chamber; (c) manual pumping means actuatable to pressurize air in said air chamber, said manual pumping means comprising a manually actuatable plunger or piston and urging means to urge said plunger to an undepressed, unactuated position; (d) venting means for venting said air chamber to ambient pressure prior to actuation of said pumping means, said venting means comprising a one-way air chamber valve for opening to allow ambient air to enter said air chamber when the pressure in said air chamber is at or below ambient pressure and for closing when the air pressure in said air chamber rises above ambient air pressure; (e) valved duct means for communicating pressurized air from said air chamber to said reservoir via a one-way non-return valve, said duct means having a valve air inlet portion above the one-way non-return valve, said duct means incorporating said valve, and said valve having a mouth communicating with said reservoir; said valve having a valve chamber and a reciprocatable valve element, said valve configured so as to provide a cavity between at least said valve air inlet portion and said mouth in order to trap a bubble of air in a portion of said cavity below said air inlet and above said mouth; (f) a slot in said reservoir, said slot having a second basal dispensing opening; (g) a nozzle housing received by said first and second basal dispensing openings in communication with said reservoir; (h) a nozzle received by said nozzle housing in fluid communication with said reservoir; (i) a first means for selectively blocking the dispensing of material through said first and second basal dispensing opening comprising: a slider leg depending from said plunger and associated with said first and second basal dispensing openings with said leg blocking the dispensing of material when said plunger is in a first undepressed position, and said leg not blocking the dispensing of material when said plunger is depressed to a second position; said manual plunger being operatively connected to said first means for selectively blocking the dispensing of material through said first and second basal dispensing openings; whereby ambient air in said air chamber may be pressurized in order to communicate pressurised air to said reservoir through said one-way air non-return valve so that when said reservoir contains viscous material and said nozzle is not blocked, viscous material at said second basal dispensing opening is exposed to ambient air pressure so that viscous material in said reservoir is urged to exit through said nozzle by the pressure differential between the pressure in said reservoir and ambient air pressure, and whereby repeated actuation of said pumping means may build up pressure in said reservoir due to said non-return valve and whereby air trapped below said air inlet portion and above said mouth prevents reservoir fluid fouling said valve; (j) means for selectively urging and blocking the dispensing of material through said second basal dispensing opening comprising: a plunger arm depending from said plunger and associated with said first and second basal dispensing openings with said arm urging the dispensing of material through said second basal dispensing opening when said plunger is depressed from said undepressed first position to said depressed second position, and with said arm not urging the dispensing of material through said second basal dispensing opening when said plunger is in said first undepressed position, or when said plunger is in said second depressed position, or when said plunger is returning from said depressed second position to said undepressed first position; and with said arm blocking the dispensing of material through said nozzle when said plunger is in said depressed second position and with said arm blocking the dispensing of material through said second basal dispensing opening during at least a portion of the return stroke of said plunger when said plunger is returning from said depressed second position to said undepressed first position; whereby mechanical pressure exerted on said nozzle by said plunger arm when said plunger is depressed may increase pressure in said nozzle so that viscous material contained in said nozzle is urged to exit through said second basal dispensing opening by the pressure differential between the pressure in said nozzle and ambient air pressure; and whereby, after viscous material contained in said nozzle is dispensed through said second basal dispensing opening and said plunger is released and is returning from said depressed second position to said undepressed first position, the mechanical pressure exerted on said nozzle by said plunger arm may be reduced when said plunger is returning to said undepressed first position and pressure in said nozzle may fall below ambient air pressure so that material at said second basal dispensing opening may be urged by a pressure differential to re-enter said nozzle while said nozzle is not blocked by said first selective blocking means; and whereby mechanical pressure is exerted on said nozzle by said plunger arm when said plunger is in said depressed second position so that said nozzle is pinched closed between said arm and said nozzle housing, thereby blocking the dispensing of viscous material through said nozzle; and whereby mechanical pressure is maintained on said nozzle by said arm when said plunger is released and is returning from said depressed second position to said undepressed first position so that said nozzle remains pinched closed between said arm and said nozzle housing during at least a portion of the return stroke of said plunger when said plunger is returning from said depressed second position to said undepressed first position, thereby blocking the dispensing of viscous material through said nozzle; and whereby viscous material contained in said reservoir may be blocked from entering said nozzle by said second selective blocking means when said plunger is in said depressed second position and during at least a portion of the return stroke of said plunger when said plunger is returning from said depressed second position to said undepressed first position, and free to enter said nozzle when said plunger is in said undepressed first position.

BRIEF DESCRIPTION OF THE DRAWINGS

In the figures which describe example embodiments of the invention:

FIG. 1*a* is a vertical sectional side view of a dispensing unit made in accordance with this invention;

FIG. 1*b* is an enlarged detail view of FIG. 1*a:*

FIG. 3*a* is a horizontal sectional top view of FIG. 1*a* along the plane defined by 3—3 of FIG. 1*a* showing the unit in an unactuated mode;

FIG. 3*b* is a horizontal sectional top view of FIG. 1*a* along the plane defined by 3—3 of FIG. 1*a* showing the unit in a full dispensing mode;

Referring to FIGS. 1*a* through 3*b* and 7, a dispensing device indicated generally at 10 includes a reservoir 82 suitable for retaining a viscous material 86 to be dispensed (such as liquid soap, shampoo, hand lotion or the like), and a manual pumping means 16.

Figure 2:
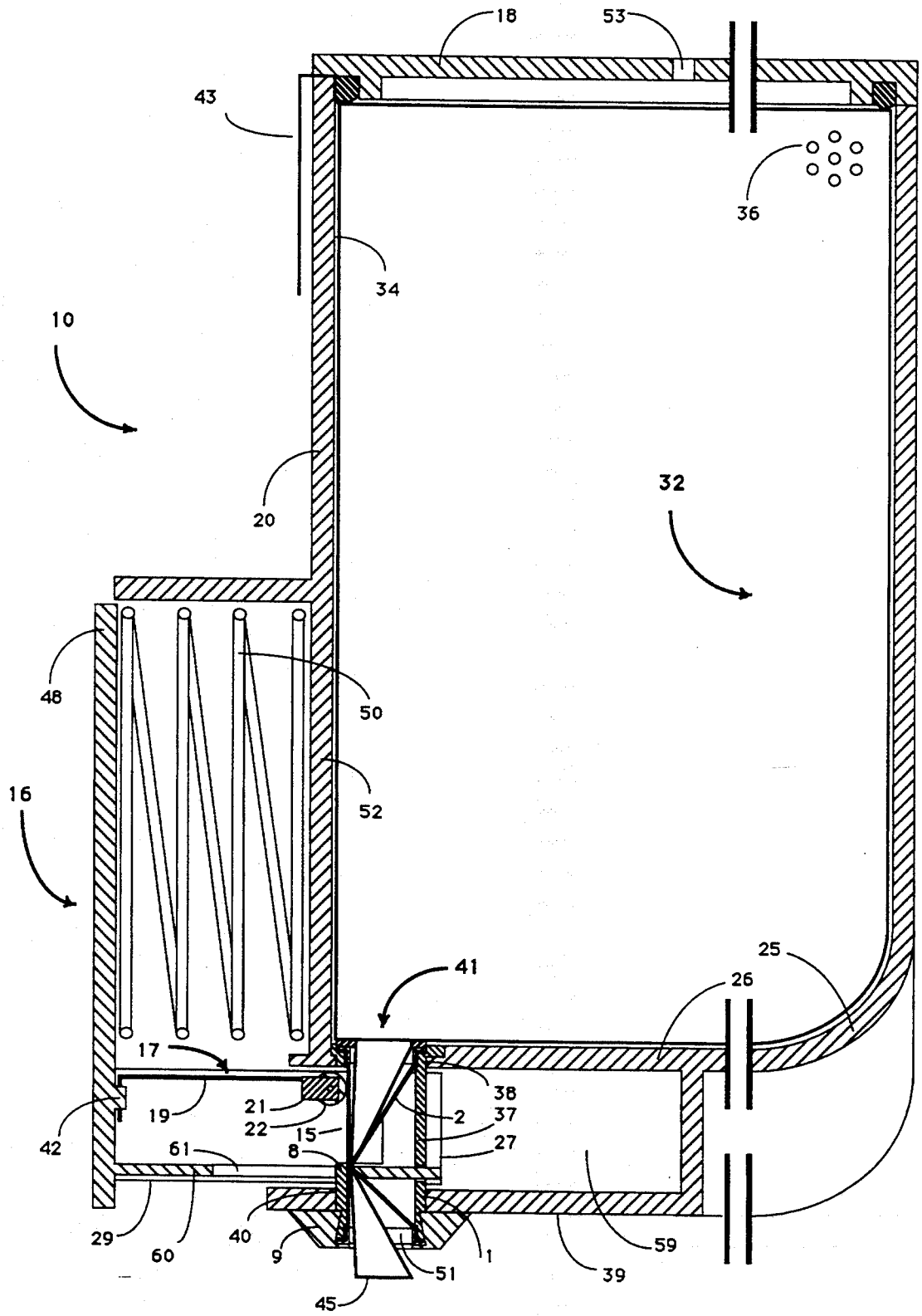
FIG. 2 is a vertical sectional side view showing the refill sac with the refill sac nozzle inserted through the nozzle.

Reservoir 32 has a lid 18 and a bottom wall 26. Lid 18 has a vent 53 for allowing ambient air to pass into reservoir 32 when pressure in the reservoir drops below ambient. A basal dispensing opening 38 in bottom wall 26 is fitted with a nozzle indicated generally at 41. Bottom wall 26 of the reservoir may be sloped towards basal dispensing opening 38 as indicated at 25. Additionally, although not shown, the sides of the dispensing unit may be sloped towards the basal dispensing opening. The sloping of the bottom and side walls of the dispensing unit facilitate drainage of the reservoir contents.

The manual pumping means comprises a plunger (or piston) 48. A spring 50 is positioned between back wall 52 and the plunger 48, so as to urge plunger 48 to the undepressed position shown in FIGS. 1*a* and 1*b*.

A slot 59 in bottom wall 26 of the reservoir extends from the front edge of the bottom wall to beyond the dispensing opening 38. Nozzle 41 projects through slot 59 and through a second basal dispensing opening 40 in bottom wall 39 of slot 59. A slider 60 depending from the bottom of plunger 48 is slideably received within slot 59. Thus the slot functions as a slider guide. Slider 60 has side walls 27 and ridges 28 and 29 which stabilize the plunger and minimize friction as the plunger moves in slot 59, and a medial opening 61 which receives nozzle 41. As best seen in FIGS. 3*a* and 3*b*, opening 61 has a back edge indicated generally at 62 which comprises a medial concave semi-circular portion 65 formed by wedge-shaped tang 67 of the slider and convex wings 66 on either side of the concave semi-circular portion. As will be described hereinafter, back edge 62 functions as a nozzle pinching edge. The slider has slots 63 which receive set screws 64 threaded into bottom wall 39 of slot 59 and bottom wall 26 of the reservoir; slots 63 and set screws 64 prevent the withdrawal of the slider from slot 59 and limit the distance the plunger can be depressed in slot 59.

As best seen in enlarged detail FIG. 1*b* plunge 48 has a retention pin 42 which retains one end of flexible spring-blade 19 of one-way ejector 17. The opposite end of flexible spring-blade 19 incorporates a spherical roller indicated generally at 22 and has a vertical offset portion 21. Vertical offset portion 21 lies in a vertical plane transverse to the horizontal short axis of flexible spring-blade 19 and positions the roller axle slightly below the horizontal axis of flexible spring-blade 19. The vertical offset effectively causes flexible spring-blade 19 to bend only one way from the horizontal axis, thereby forcing roller 22 downwards whenever frontal pressure acts on the roller.

Spherical roller 22 comprises two hemispheres 54 joined at the equatorial middle by axle 55. Axle 55 lies in a horizontal plane transverse to the long axis of spring-blade 19 and is rollably housed in vertical offset portion 21. Vertical offset portion 21 has a minimum clearance fit between the two hemispheres to just allow the hemispheres to spin freely on the axle. Thus vertical offset portion 21 also acts as a guide to keep roller 22 aligned in a vertical plane transverse to the horizontal short axis of spring-blade 19. It is noted that vertical offset portion 21 is of minimum thickness so that the gap between hemispheres 54 is minimal and the spherical roller surface thereby is essentially continuous. It is also noted that the top, bottom and leading edges of vertical offset portion 21 are dimensioned so as not to protrude beyond the equatorial circumference of the hemispheres.

Nozzle 41 has a tubular nozzle housing 1 with a tubular top portion 5, a tubular bottom portion 8 and a partially tubular back wall portion 37. Key 31 on tubular top portion 5 fits into respective keyway 35 in bottom wall 26 to properly position and hold the nozzle housing in basal dispensing opening 38. Tubular top portion 5 has a sealing rim 6 extending into respective relief 7 in bottom wall 26 to sealingly retain the nozzle housing in circular basal dispensing opening 38. Tubular bottom portion 8 is retained in circular basal dispensing opening 40 by engaging respective reliefs 11 and 12 on tubular bottom portion 8 and collar 9.

Nozzle housing 1 has an opening 15 between the tubular top portion and the tubular bottom portion which slideably receives one-way ejector 17, and tubular bottom portion 8 has an opening 13 which slideably receives pinching edge 62 of slider opening 61.

Nozzle housing 1 houses resilient tubular nozzle 2. Top sealing rim 23 and bottom sealing rim 24 of resilient tubular nozzle 2 are retained in nozzle housing 1 by retaining tings 3. Retaining tings 3 sealingly engage respective reliefs 4 in tubular top portion 5 and tubular bottom portion 8.

In operation, when plunger 48 is in an undepressed position as shown in FIGS. 1*a* and 1*b*, slider 60 of plunger 48 pinches the bottom of resilient tubular nozzle 2 closed between the pinching edge 62 of slider opening 61 and the front wall of tubular bottom portion 8. Roller 22 of one-way ejector 17 is not in pressure contact with resilient tubular nozzle 2 and flexible spring-blade 19 is not bent downward from the horizontal axis.

As plunger 48 is depressed against the resistance of spring 50, spring-blade 19 of one-way ejector 17 moves through opening 15 of nozzle housing 1 and pinches closed the top portion of resilient tubular nozzle 2 between roller 22 and the top portion of back wall 37. Simultaneously, as plunger 48 is depressed, opening 61 in slider 60 moves into alignment with basal dispensing openings 38 and 40, thereby allowing the bottom portion of resilient tubular nozzle 2 to open. As plunger 48 continues to be depressed, vertical offset 21 causes flexible spring-blade 19 to bend downwards from the horizontal axis, forcing roller 22 to roll downwards towards the bottom portion of resilient tubular nozzle 2. Provided the stiffness of flexible spring-blade 19 is sufficient, roller 22 will continue to pinch resilient tubular nozzle 2 closed against back wall 37 as long as plunger 48 continues to be depressed. It is noted that the outside diameter of roller 22 is dimensioned for a clearance fit inside tubular housing I when the roller pinches resilient tubular nozzle 2 closed against back wall 37.

In consequence, when plunger 48 is depressed, viscous material in the bottom of reservoir 32 and in tubular nozzle 2, above the point where the nozzle was pinched closed between pinching edge 62 and the front wall of tubular bottom portion 8, will be at a higher than ambient pressure due to the force of gravity, whereas ambient air pressure will be exerted upon the material below the point where the nozzle was pinched closed, thus creating a pressure differential. This pressure differential urges the viscous material through the nozzle. Furthermore, when plunger 48 is depressed, the quantity of viscous material in resilient tubular nozzle 2, below the point where roller 22 first pinches the top portion of the nozzle closed against back wall 37, is forced down and out through the nozzle by the mechanical pressure exerted on the nozzle as roller 22 rolls downward and the stiffness of spring-blade 19 continues to pinch the nozzle closed against back wall 37 of nozzle housing 1.

As plunger 48 is released, spring 50 (and to a minor degree, the rebound of flexible spring-blade 19 back up to the horizontal axis) urges plunger 48 towards the undepressed position of FIGS. 1*a* and 1*b*. As roller 22 moves back up wall 117, the portion of resilient tubular nozzle 2 below the pinching edge of the roller expands to resume its normal tubular shape, thereby reducing the pressure in the expanding portion of resilient tubular nozzle 2. If, on the return stroke of plunger 48, the air pressure in the expanding resilient tubular nozzle portion falls below ambient while the bottom portion of nozzle 2 remains partially unrestricted, a pressure differential results which exerts a force on any material remaining in mouth 51 of resilient tubular nozzle 2, thereby urging said material to re-enter the expanding resilient tubular nozzle portion and preventing drips. It is noted that in the case of high viscosity material, this force may be insufficient to cause the residual material remaining in mouth 51 to re-enter the expanding resilient tubular nozzle portion, thereby creating a vaccum in the expanding resilient tubular nozzle portion.

This force acting on any material remaining in mouth 51 of nozzle 2 disappears when either the nozzle becomes completely restricted by pinching edge 62, or roller 22 ceases to pinch closed the top portion of nozzle 2.

At the end of the return stroke of plunger 48, pinching edge 62 of opening 61 moves forward through opening 13, and the semi-circular portion 65 of wedge-shaped tang 67 first contacts and then increasingly deforms the bottom portion of nozzle 2 toward a crescent moon shape as the semi-circular edge portion pinches the resilient tubular nozzle against the front wall of tubular tubular bottom portion 8 and the convex wings 66 of the nozzle pinching edge receive the tips of the forming crescent moon shape. In this way, the bottom portion of nozzle 2 is increasingly restricted as roller 22 simultaneously unpinches the top portion of the nozzle.

Due to the force of gravity acting on the viscous material in the reservoir, viscous material is forced into the top portion of resilient tubular nozzle 2 by the pressure differential between pressure in the bottom of reservoir 82 and the vacuum or ambient pressure in expanding resilient tubular nozzle 2 above the point where the nozzle is pinched closed by pinching edge 62.

Air pressure in reservoir 82 is reduced by the dispensing of material through nozzle 41. The resultant pressure differential forces ambient air to flow through opening 58 in lid 18, thereby maintaining reservoir pressure at ambient.

Additionally, as plunger 48 is depressed, mechanical pressure is exerted on the quantity of viscous material residing in the length of nozzle below the point where nozzle 2 is first pinched closed by roller 22 as it moves against and then downwards along back wall 37. This mechanical pressure, in conjunction with the pressure differential of the viscous material residing in said length of nozzle 2, forces said quantity of viscous material to be discharged out of the nozzle. As a consequence, the dosage volume per stroke is regulated because it is limited to the quantity of viscous material residing in the length of resilient tubular nozzle 2 at the beginning of each stroke. This dosage volume is a function of the inside diameter of nozzle 2 and the length of nozzle 2 which is pinched closed by roller 22 as it moves downwards against back wall 37. Simultaneously, as plunger 48 is depressed and roller 22 pinches resilient tubular nozzle 2 closed against back wall 37, leakage of less viscous, watery material is substantially reduced because the stiffness of spring-blade 19 allows roller 22 to continue to pinch nozzle 2 closed against back wall 37 for as long as plunger 48 remains depressed.

As seen in FIG. 2, if the tubular nozzle of a flexible, thin-walled sac filled with viscous material is inserted through resilient tubular nozzle 2, the dispensing unit such as described in connection with FIGS. 1*a* through 3*b* may be used with a sac of viscous material. Thus, it will be seen that the FIG. I dispensing unit may be dual purpose, that is, a viscous liquid may be added directly to reservoir 32 of the FIG. 1*a* dispensing unit, or a sac of viscous fluid may be placed in the reservoir. FIG. 2 illustrates the dispensing unit of FIG. 1*a* with a flexible, thin-walled sac 34 in place and tubular nozzle 45 of sac 34 inserted through resilient tubular nozzle 2. The sac is dimensioned for a close fit inside reservoir 32 and has a tab 43 proximate its top which extends between the front wall 20 of the unit and lid 18 to outside of the unit. The front wall and lid sandwich the tab to retain it in position.

As seen in FIG. 2, the seam where tubular sac nozzle 45 emerges from the bottom wall of sac 34 is a thickened snap ring 44 which sealingly engages respective relief 47 in sealing rim 6 of nozzle housing 1.

Figure 7:
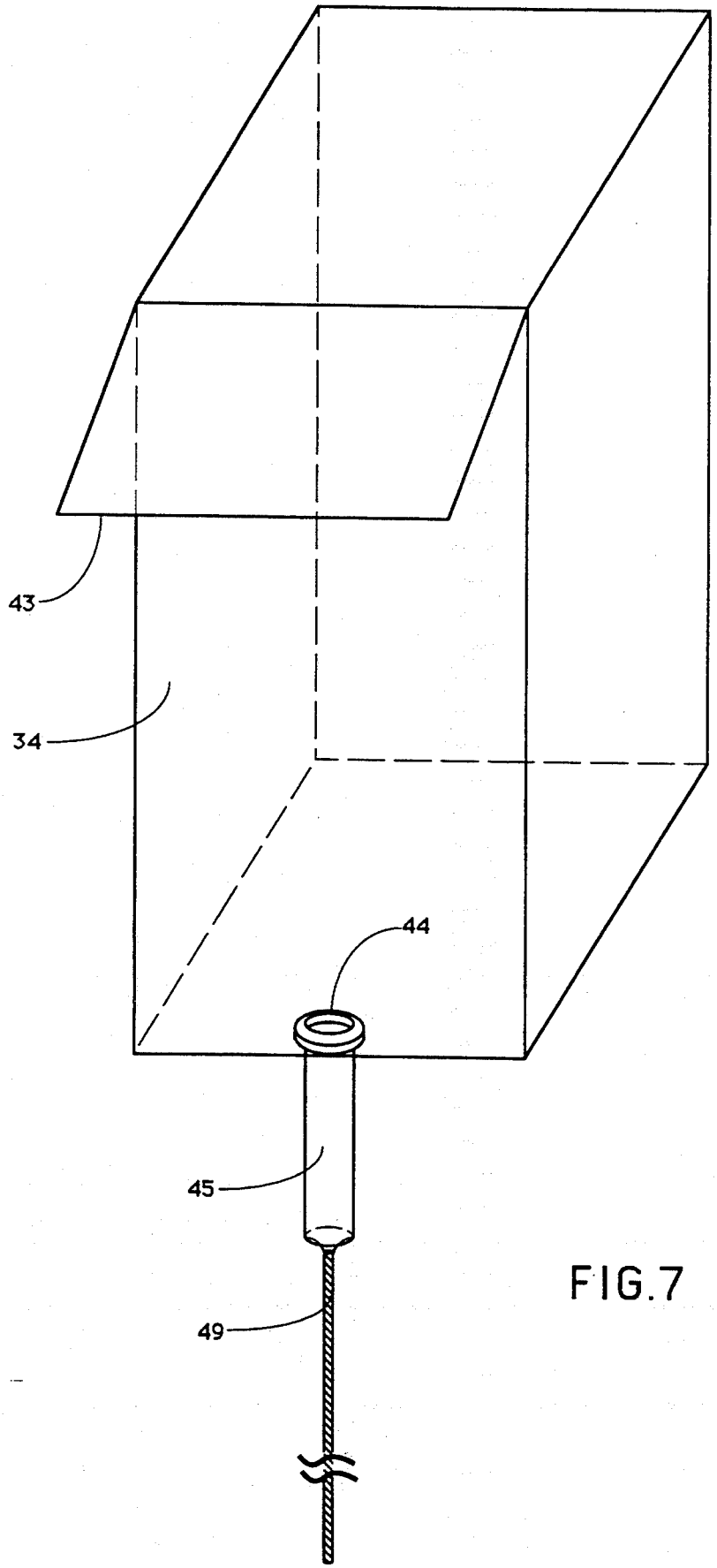
FIG. 7 is a perspective view of a refill sac showing the contents information tab and the sealing pin.

As seen in FIG. 7, the sac nozzle initially has a pin 49 attached to its end. The pin is rigid and its length approximates the height of reservoir 32 so as to facilitate location and insertion of the sac nozzle into resilient tubular nozzle 2. Pin 49 is detached from the sac nozzle by tearing or cutting the sac nozzle above the pin, thereby opening the sac nozzle for dispensing the sac contents.

As the viscous material in sac 34 is depleted, the sac crumples. However, tab 43 and snap ring 44 in conjunction with the pinching of the sac nozzle inside resilient nozzle 2 as nozzle 2 is pinched between pinching edge 62 and the front wall of tubular bottom portion 8, maintain the front wall of the sac taut. This facilitates drainage of the viscous material from the sac. Additionally, when the material in the sac is exhausted, the tab facilitates removal of the sac after lid 18 is opened. The tab may also contain information on the sac contents.

In operation, lid 18 may be opened and a sac 34 inserted into reservoir 32. It will be noted that tab 43 and pin 49 facilitate proper orientation of the sac and the sac nozzle in the reservoir. As the sac is lowered into the reservoir, pin 49 facilitates location of sac nozzle 45 in basal dispensing opening 38 and the rigid pin facilitates insertion into resilient nozzle 2. As the point of pin 49 meets resistance where the bottom portion of resilient tubular nozzle 2 is pinched closed between pinching edge 62 and the front wall of tubular bottom portion 8, plunger 48 is depressed slightly to align slider opening 61 with nozzle 41, thereby unpinching resilient tubular nozzle 2 and permitting passage of rigid pin 49 through nozzle 2. The rigid pin may then be pulled through nozzle 2 until snap ring 44 of sac nozzle 45 sealingly engages respective relief 47 in sealing rim 6. It will be noted that while plunger 48 is depressed, the one-way downward bend of flexible spring-blade 19 facilitates easy passage of rigid pin 49 and sac nozzle 45 past pinching roller 22. Now plunger 48 may be released and lid 18 closed, clamping tab 43 in position. Sac nozzle 45 may then be opened by detaching (cutting or tearing) the sac nozzle above the point where pin 49 is attached to the sac nozzle.

Figure 4:
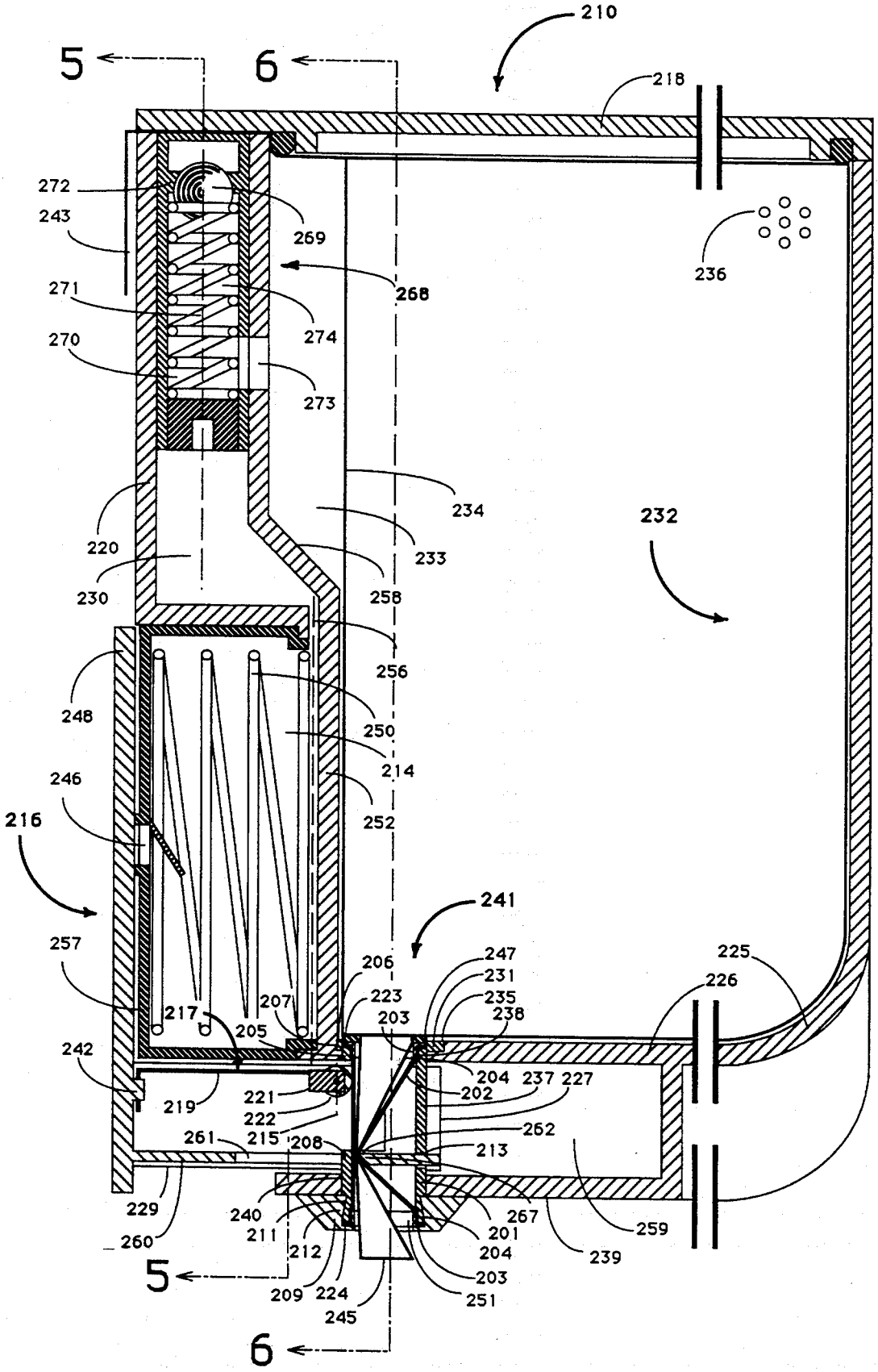
FIG. 4 is a vertical sectional side view of another embodiment of a dispensing unit made in accordance with this invention, showing the refill sac with the refill sac nozzle inserted through the nozzle.
Figure 5:
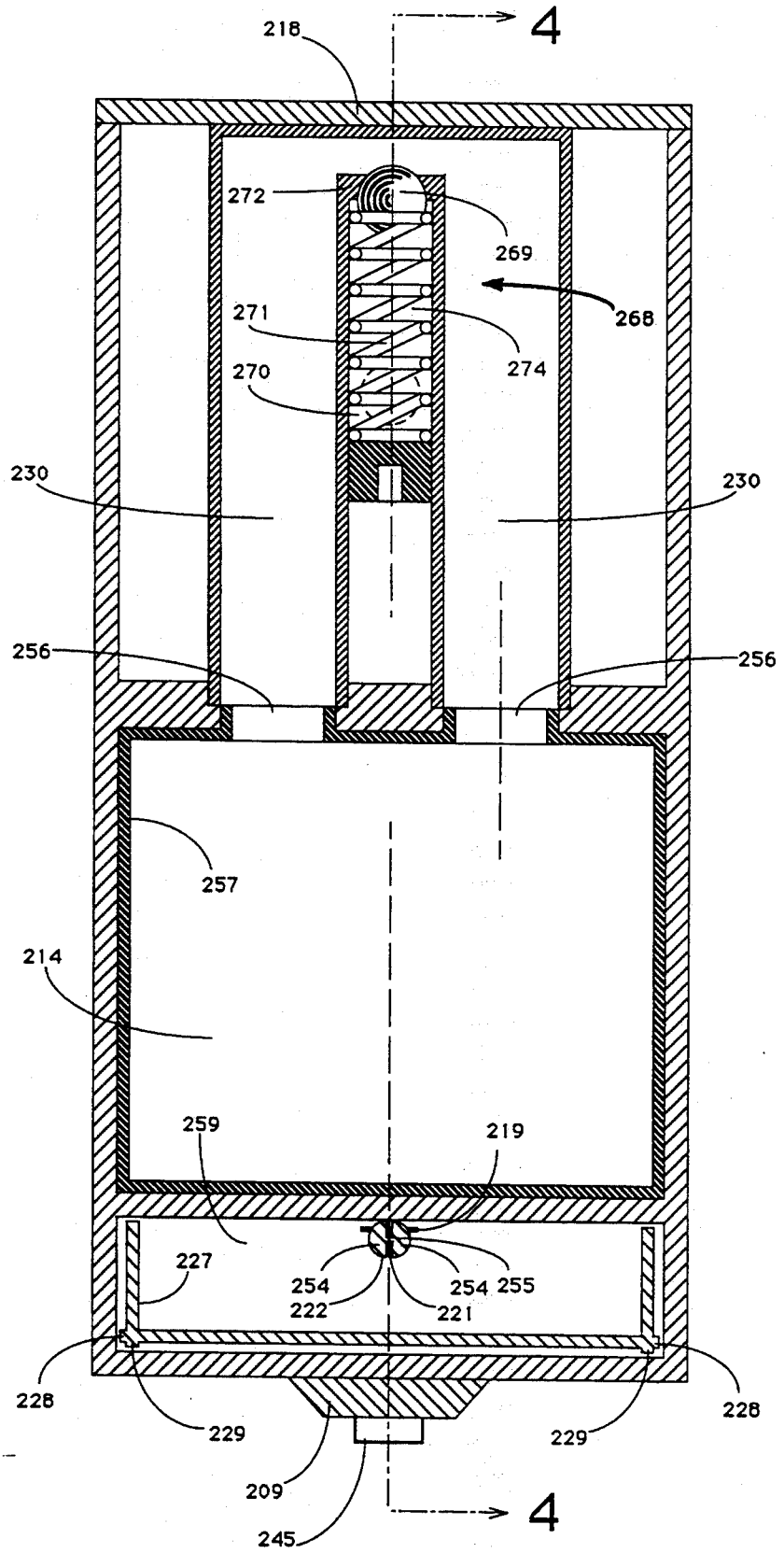
FIG. 5 is a vertical sectional front view of FIG. 4 along the plane defined by 5—5 of FIG. 4.
Figure 6:
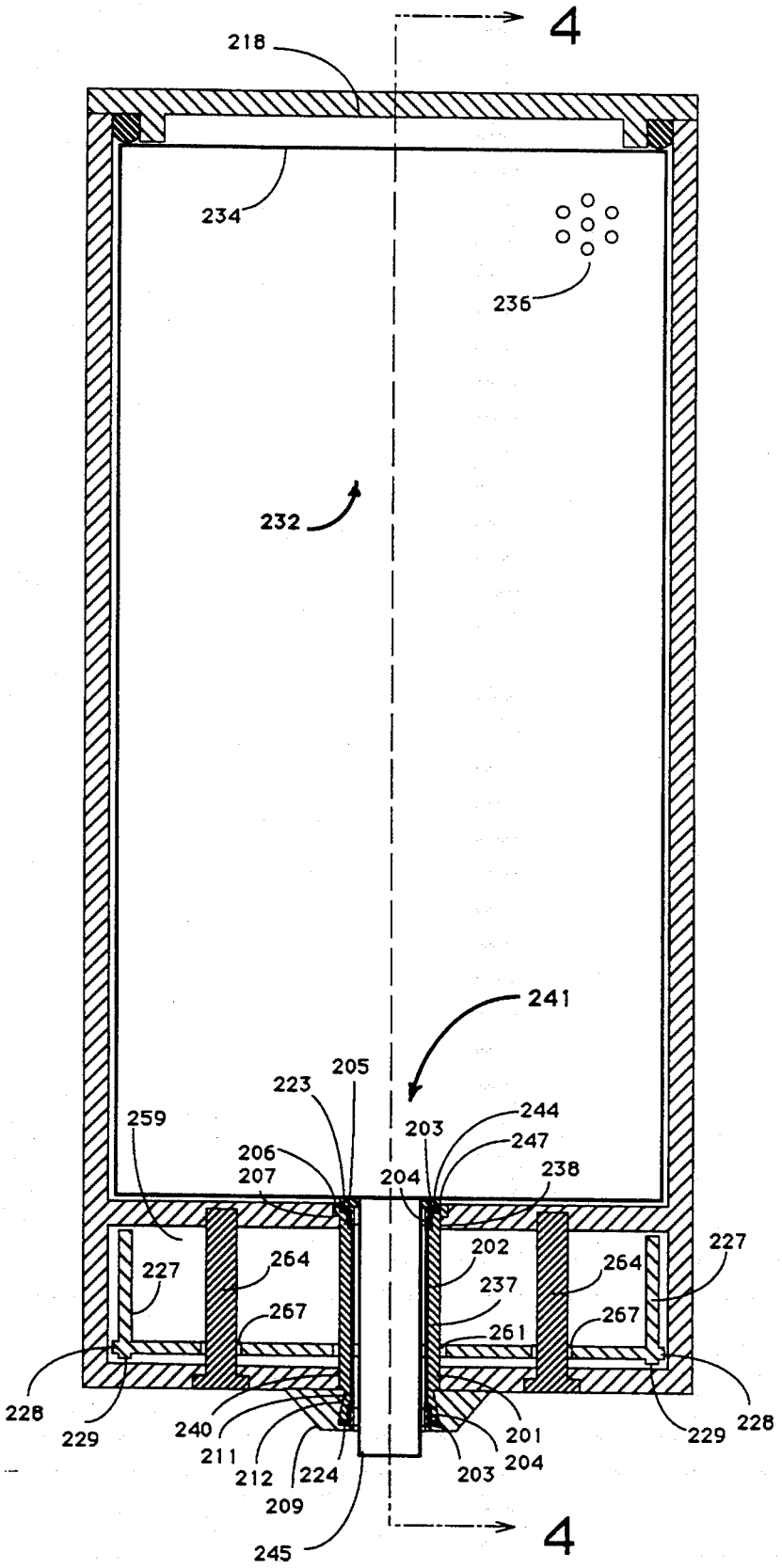
FIG. 6 is a vertical sectional front view of FIG. 4 along the plane defined by 6—6 of FIG. 4.

In the embodiment of FIGS. 4, 5 and 6, a dispensing device indicated generally at 210 includes a reservoir 232 suitable for retaining a viscous material 236 to be dispensed (such as liquid soap, shampoo, hand lotion or the like), an air chamber 214, and a manual pumping means 216.

Reservoir 232 has an air tight lid 218 and a bottom wall 226. A basal dispensing opening 238 in bottom wall 226 is fitted with a nozzle indicated generally at 241. Bottom wall 226 of the reservoir may be sloped towards the basal dispensing opening 238 as indicated at 225. Additionally, although not shown, the sides of the dispensing unit may be sloped towards the basal dispensing opening. The sloping of the bottom and side walls of the dispensing unit facilitate drainage of the reservoir contents.

The manual pumping means comprises a plunger (or piston) 248 which abuts one side of bellows 257 lining air chamber 214. Bellows 257 also has a one-way air intake valve 246 for allowing ambient air to pass into air chamber 214 when one-way valve 246 is open. A spring 250 is positioned within air chamber 214 between back wall 252 of air chamber 214 and plunger 248, so as to urge the plunger to the undepressed position shown in FIG. 4.

An air duct 230 extends from air chamber 214 to proximate the top of reservoir 232 and a passageway 256 connects the air chamber with the air duct. The top portion of air duct 230 turns back on itself to form a valve air inlet portion. This duct portion incorporates a one-way non-return ball valve 268 and terminates in a mouth 273. The ball valve comprises a valve chamber 270 containing a ball 269 which has a clearance fit within the chamber and is urged into a ball seat 272 by spring 271. Valve chamber 270 terminates at mouth 273; consequently, the valve chamber extends below the ball when the ball is seated, as shown in FIG. 4. Thus, there is a cavity 274 between ball 269 and mouth 273 of the valve when the ball is seated which traps a pocket of air in a portion of the cavity below the valve air inlet and above mouth 273 when the reservoir is filled with a viscous material 236. The one-way non-return ball valve allows pressurized air to pass from the air duct into reservoir 232 while preventing viscous fluid or air in the reservoir from flowing into the air duct.

A slot 259 in bottom wall 226 of the reservoir extends from the front edge of the bottom wall to beyond the dispensing opening 238. Nozzle 241 projects through slot 259 and through a second basal dispensing opening 240 in bottom wall 239 of slot 259. A slider depending from the bottom of plunger 248 is slideably received within slot 259. Thus the slot functions as a slider guide. Slider 260 has side walls 227 and ridges 228 and 229 which stabilize the plunger and minimize friction as the plunger moves in slot 259, and a medial opening 261 which receives nozzle 241. Opening 261 has a back edge indicated generally at 262 which functions as a nozzle pinching edge.

Plunger 248 has a retention pin 242 which retains one end of flexible spring-blade 219 of one-way ejector 217. The opposite end of flexible spring-blade 219 incorporates a spherical roller indicated generally at 222 and has a vertical offset portion 221. Vertical offset portion 221 lies in a vertical plane transverse to the horizontal short axis of flexible spring-blade 219 and positions the roller axle slightly below the horizontal axis of flexible spring-blade 219. The vertical offset effectively causes flexible spring-blade 219 to bend only one way from the horizontal axis, thereby forcing roller 222 downwards whenever frontal pressure acts on the roller.

Spherical roller 222 comprises two hemispheres 254 joined at the equatorial middle by axle 255. Axle 255 lies in a horizontal plane transverse to the long axis of spring-blade 219 and is rollably housed in vertical offset portion 221. Vertical offset portion 221 has a minimum clearance fit between the two hemispheres to just allow the hemispheres to spin freely on the axle. Thus vertical offset portion 221 also acts as a guide to keep roller 222 aligned in a vertical plane transverse to the horizontal short axis of spring-blade 219. It is noted that vertical offset portion 221 is of minimum thickness so that the gap between hemispheres 254 is minimal and the spherical roller surface thereby is essentially continuous. It is also noted that the top, bottom and leading edges of vertical offset portion 221 are dimensioned so as not to protrude beyond the equatorial circumference of the hemispheres.

Nozzle 241 has a tubular nozzle housing 201 with a tubular top portion 205, a tubular bottom portion 208 and a partially tubular back wall portion 237. Key 231 on tubular top portion 205 fits into respective keyway 235 in bottom wall 226 to properly position and hold the nozzle housing in basal dispensing opening 238. Tubular top portion 205 has a sealing rim 206 extending into respective relief 207 in bottom wall 226 to sealingly retain nozzle 241 in basal dispensing opening 238. Tubular bottom portion 208 is retained in basal dispensing opening 240 by engaging respective reliefs 211 and 212 on tubular bottom portion 208 and collar 209.

Nozzle housing 201 has an opening 215 between the tubular top portion and the tubular bottom portion which slideably receives one-way ejector 217, and tubular bottom portion 208 has an opening 213 which slideably receives pinching edge 262 of slider opening 261.

Nozzle housing 201 houses resilient tubular nozzle 202. Top sealing rim 223 and bottom sealing rim 224 of resilient tubular nozzle 202 are retained in nozzle housing 201 by retaining rings 203. Retaining rings 203 sealingly engage respective reliefs 204 in tubular top portion 205 and tubular bottom portion 208.

In operation, when plunger 248 is in an undepressed position as shown in FIG. 4, one-way air valve 246 is open and the air pressure in air chamber 214 is ambient. In the undepressed position, slider 260 of plunger 248 pinches the bottom of resilient tubular nozzle 202 closed between the pinching edge 262 of slider opening 261 and the front wall of tubular bottom portion 208. Roller 222 of one-way ejector 217 is not in pressure contact with resilient tubular nozzle 202 and flexible spring-blade 219 is not bent downward from the horizontal axis.

As plunger 248 is depressed against the resistance of spring 250, the air pressure in air chamber 214 increases, thereby closing one-way air valve 246. As plunger 248 continues to be depressed, the air pressure in air chamber 214 continues to increase and this increased air pressure, if greater than the back pressure in reservoir 232 (ignoring the minor additional pressure needed to overcome the resistance of the spring of the ball valve), opens one-way ball valve 268 so that pressurized air is communicated to the reservoir. Because of the clearance fit of the ball within the valve chamber and the biasing force of spring 271, ball 269 only moves just clear of its seat when air is pumped through the valve. This ensures that air in a portion of cavity 274 below the valve air inlet and above mouth 273 is maintained during the pumping of air through the valve so that there is a trapped pocket of air in this cavity at all times. Furthermore, as plunger 248 is depressed, one-way ejector 217 moves through opening 215 of nozzle housing 201 and pinches closed the top of portion of resilient tubular nozzle 202 between roller 222 and the top portion of back wall 237. Simultaneously, as plunger 248 is depressed, opening 261 in slider 260 moves into alignment with basal dispensing openings 238 and 240, thereby allowing the bottom portion of resilient tubular nozzle 202 to open. As plunger 248 continues to be depressed, vertical offset 221 causes flexible spring-blade 219 to bend downwards from the horizontal axis, forcing roller 22 to roll downwards towards the bottom portion of resilient tubular nozzle 202. Provided the stiffness of flexible spring-blade 219 is sufficient, roller 222 will continue to pinch resilient tubular nozzle 202 closed against back wall 237 as long as plunger 248 continues to be depressed. It is noted that the outside diameter of roller 222 is dimensioned for a clearance fit inside tubular housing 201 when the roller pinches resilient tubular nozzle 202 closed against back wall 237.

In consequence, when plunger 248 is depressed, viscous material in reservoir 232 and in tubular nozzle 202, above the point is where the nozzle was pinched closed between pinching edge 262 and the front wall of tubular bottom portion 208, will be at a higher than ambient pressure due to the force of gravity and the pressurization of reservoir 232, whereas ambient air pressure will be exerted upon the material below the point where the nozzle was pinched closed, thus creating a pressure differential. This pressure differential urges the viscous material through the nozzle. Furthermore, when plunger 248 is depressed, the quantity of viscous material in resilient tubular nozzle 202, below the point where roller 222 first pinches the top portion of the nozzle closed against back wall 237, is forced down and out through the nozzle by the mechanical pressure exerted on the nozzle as roller 222 rolls downward and the stiffness of flexible spring-blade 219 continues to pinch the nozzle closed against back wall 237 of nozzle housing 201.

As plunger 248 is released, spring 250 (and to a minor degree, the rebound of flexible spring-blade 219 back up to the horizontal axis) urges plunger 248 towards the undepressed position of FIG. 4, thereby increasing the volume of air and hence reducing the air pressure in chamber 214 and duct 230. Once pressure in air chamber 214 drops to ambient, one-way air valve 246 opens, allowing air to enter the air chamber. As roller 222 moves back up wall 237, the portion of resilient tubular nozzle 202 below the pinching edge of the roller expands to resume its normal tubular shape, thereby reducing the pressure in the expanding portion of resilient tubular nozzle 202. If, on the return stroke of plunger 248, the air pressure in the expanding resilient tubular nozzle portion falls below ambient while the bottom portion of nozzle 202 remains partially unrestricted, a pressure differential results which exerts a force on any material remaining in mouth 251 of resilient tubular nozzle 202, thereby urging said material to re-enter the expanding resilient tubular nozzle portion and preventing drips. It is noted that in the case of high viscosity material, this force may be insufficient to cause the residual material remaining in mouth 251 to re-enter the expanding resilient tubular nozzle portion, thereby creating a vaccum in the expanding resilient tubular nozzle portion.

This force acting on any material remaining in mouth 251 of nozzle 202 disappears when either the nozzle becomes completely restricted by pinching edge 262, or roller 222 ceases to pinch closed the top portion of nozzle 202.

At the end of the return stroke of plunger 248, pinching edge 262 of opening 261 moves forward through slot 213, increasingly deforming and finally pinching the bottom portion of nozzle 202 against the front wall of tubular bottom portion 208. In this way, the bottom portion of nozzle 202 is increasingly restricted as roller 222 simultaneously unpinches the top portion of the nozzle.

In addition to the force of gravity acting on the viscous material 236 in reservoir 232, increased pressure in the reservoir is maintained due to one-way non-return ball valve 268 and viscous material therefore is forced into the top portion of resilient tubular nozzle 202 by the pressure differential between pressure in the reservoir 232 and the vacuum or ambient pressure in expanding resilient tubular nozzle 202 above the point where the nozzle is pinched closed by pinching edge 262.

As a result of one-way non-return ball valve 268, pressure in the reservoir is only reduced by the dispensing of material through nozzle 241. Consequently, it is possible to pump up the pressure in the reservoir to significantly above ambient pressure as follows: Depending upon the viscosity of material 236, the pressure developed in reservoir 232 during a stroke of plunger 248 may be insufficient for sufficient material to be discharged from the reservoir to reduce the pressure in reservoir 232 to ambient in the time period during which nozzle 202 is open. In such circumstances, when the bottom portion of resilient tubular nozzle 202 recloses, the air pressure in reservoir 232 will remain above ambient. Accordingly, when plunger 248 is again depressed, the air pressure in reservoir 232 is further increased, limited only by the maximum air pressure that can be developed in air chamber 214. By being able to pump up the air pressure in the reservoir, it may be possible to dispense high viscosity materials through nozzle 241. Additionally, in the case of high viscosity materials, any vacuum formed as resilient tubular nozzle 202 expands to resume its normal tubular shape as roller 222 rolls back up to the horizontal axis and unpinches the resilient tubular nozzle reinforces the effect of the above-ambient air pressure in the reservoir by adding to the pressure differential forcing said high viscosity material into the top portion of resilient tubular nozzle 202 above the point where the nozzle is pinched closed by pinching back edge 262 of slider 260.

Additionally, as plunger 248 is depressed, mechanical pressure is exerted on the quantity of viscous material residing in the length of nozzle below the point where nozzle 202 is first pinched closed by roller 222 as it moves against and then downwards along back wall 237. This mechanical pressure, in conjunction with the pressure differential of the viscous material residing in said length of nozzle 202, forces said quantity of viscous material to be discharged out of the nozzle. As a consequence, the dosage volume per stroke is regulated because it is limited to the quantity of viscous material residing in the length of resilient tubular nozzle 202 at the beginning of each stroke. This dosage volume is a function of the inside diameter of nozzle 202 and the length of nozzle 202 which is pinched closed by roller 222 as it moves downwards against back wall 237. Simultaneously, as plunger 248 is depressed and roller 222 pinches resilient tubular nozzle 202 closed against back wall 237, leakage of less viscous, watery material is substantially reduced because the stiffness of spring-blade 219 allows roller 222 to continue to pinch nozzle 202 closed against back wall 237 for as long as plunger 248 remains depressed.

The trapped air in a portion of cavity 274 is a bubble between the valve air inlet and mouth 273 which presents a barrier to the viscous material 236 in reservoir 232, thus preventing said material from contacting and fouling the ball valve. Such fouling would diminish the one-way non-return valve's air-tight and leak-proof function and make pressurization of the reservoir difficult, if not impossible.

As seen in FIG. 4, if mouth 273 of the valve 268 is proximate at the top of air duct 230 and if the tubular nozzle of a flexible, thin-walled sac filled with viscous material is inserted through resilient tubular nozzle 202, the dispensing unit such as described in connection with FIGS. 4, 5 and 6 may be used with a sac of viscous material such as described in connection with FIGS. 1*a* through 3*b* and 7. Thus, it will be seen that the FIG. 4 dispensing unit may be dual purpose, that is, a viscous liquid may be added directly to reservoir 232, or a sac of viscous fluid may be placed in the reservoir. FIG. 4 illustrates the dispensing unit with a flexible, thin-walled sac 234 in place and tubular nozzle 245 of sac 234 inserted through resilient tubular nozzle 202. The sac is dimensioned for a close fit inside reservoir 232 and has a tab 243 proximate its top which extends between front wall 220 of the unit and lid 218 to outside of the unit. The front wall and lid sandwich the tab to retain it in position. It will be noted that sloping wall 258 forms a space 233 between the upper portion of the front wall of sac 234 and sloping wall 258, thereby avoiding blockage of narrow mouth 273 by the front wall of sac 234. This space facilitates unimpeded flow of air from mouth 273 into reservoir 232, thus allowing the reservoir to be pressurized when a full sac is in place.

As seen in FIG. 4, the seam where tubular sac nozzle 245 emerges from the bottom wall of sac 234 is a thickened snap ring 244 which sealingly engages respective relief 247 in sealing rim 206 of nozzle housing 1, thus preventing leakage of pressurized air in the reservoir out between the sac nozzle and the resilient tubular nozzle when plunger 248 is depressed. The full force of increased air pressure thereby acts on the sac as reservoir 232 is pressurized.

Obviously, many other modifications and variations of the present invention are made possible in light of the above teachings. For example, the dispensing unit may have attachment means in its back wall for fastening to a vertical wall or in its bottom wall for fastening to a horizontal shelf; the dispensing unit may be held in a rack or housing holding multiple dispensing units, and the dispensing unit could be formed integrally therewith; the flexible spring-blade and nozzle housing may be designed to include a cylindrical roller pinching the resilent tubular nozzle closed against a fiat back wall; the tubular top portion of the nozzle housing may have a downward curving bottom edge seamlessly joining the partially tubular back wall portion to form a guide for an extended axle which directs the roller downwards when the plunger is depressed; the tubular bottom portion of the nozzle housing may have a vertical recess to accommodate an extended axle when the roller reaches its nadir as the plunger is fully depressed; the nozzle housing may be formed integrally as part of the dispensing unit; and the top and bottom rims of the resilient tubular nozzle may be sealingly glued or welded to the respective top and bottom tubular portions, without departing from the scope of the invention. It is therefore to be understood that within the scope of the appended claims, the invention may be practiced otherwise than as specifically described.

I claim:

1. A dispensing means for a viscous material comprising:

(a) a reservoir for containing a viscous material, said reservoir having a first basal dispensing opening, (b) a slot in said reservoir, said slot having a second basal dispensing opening, (c) a nozzle housing received by said first and second basal dispensing openings in communication with said reservoir;

(d) a nozzle received by said nozzle housing in fluid communication with said reservoir;

(e) a manual plunger and urging means to urge said plunger to an undepressed, unactuated position;

(f) a means for selectively blocking the dispensing of material through said first and second basal dispensing openings comprising:

a slider leg depending from said plunger and associated with said first and second basal dispensing openings with said leg blocking the dispensing of material when said plunger is in a first undepressed position, and said leg not blocking the dispensing of material when said plunger is depressed to a second position;

said manual plunger being operatively connected to said means for selectively blocking the dispensing of material through said first and second basal dispensing openings;

whereby the force of gravity acting on viscous material contained in said reservoir pressurizes viscous material at the bottom of said reservoir so that when said reservoir contains viscous material and said nozzle is not blocked, viscous material at said second basal dispensing opening is exposed to ambient air pressure so that viscous material at the bottom of said reservoir is urged to exit through said nozzle by the pressure differential between the pressure at the bottom of said reservoir and ambient air pressure;

(g) means for selectively urging and blocking the dispensing of material through said second basal dispensing opening comprising:

a plunger arm depending from said plunger and associated with said first and second basal dispensing openings with said arm urging the dispensing of material through said second basal dispensing opening when said plunger is depressed from said undepressed first position to said depressed second position, and with said arm not urging the dispensing of material through said second basal dispensing opening when said plunger is in said first undepressed position, or when said plunger is in said second depressed position, or when said plunger is returning from said depressed second position to said undepressed first position; and with said arm blocking the dispensing of material through said nozzle when said plunger is in said depressed second position, and with said arm blocking the dispensing of material through said second basal dispensing opening during at least a portion of the return stroke of said plunger when said plunger is returning from said depressed second position to said undepressed first position;

said manual plunger being operatively connected to said means for selectively urging and blocking the dispensing of material through said second basal dispensing opening;

whereby mechanical pressure exerted on said nozzle by said plunger arm when said plunger is depressed may increase pressure in said nozzle so that viscous material contained in said nozzle is urged to exit through said second basal dispensing opening by the pressure differential between the pressure in said nozzle and ambient air pressure; and whereby, after viscous material contained in said nozzle is dispensed through said second basal dispensing opening and said plunger is released and is returning from said depressed second position to said undepressed first position, the mechanical pressure exerted on said nozzle by said plunger arm may be reduced when said plunger is returning to said undepressed first position and pressure in said nozzle may fall below ambient air pressure so that material at said second basal dispensing opening may be urged by a pressure differential to re-enter said nozzle while said nozzle is not blocked by said selective blocking means; and whereby mechanical pressure is exerted on said nozzle by said plunger arm when said plunger is in said depressed second position so that said nozzle is pinched closed between said arm and said nozzle housing, thereby blocking the dispensing of viscous material through said nozzle; and whereby mechanical pressure is maintained on said nozzle by said arm when said plunger is released and is returning from said depressed second position to said undepressed first position so that said nozzle remains pinched closed between said arm and said nozzle housing during at least a portion of the return stroke of said plunger when said plunger is returning from said depressed second position to said undepressed first position, thereby blocking the dispensing of viscous material through said nozzle; and whereby viscous material contained in said reservoir may be blocked from entering said nozzle by said selective urging and blocking means when said plunger is in said depressed second position and during at least a portion of the return stroke of said plunger when said plunger is returning from said depressed second position to said undepressed first position, and free to enter said nozzle when said plunger is in said undepressed first position;

(h) venting means for venting said reservoir to ambient air pressure prior to actuation of said manual plunger means, said venting means comprising an opening to allow ambient air to enter said reservoir when the pressure in said reservoir is at or below ambient pressure.

2. The dispensing means of claim 1 wherein said nozzle housing is rigid and tubular, said basal dispensing openings are circular, said nozzle is resilient and tubular, and said leg comprises an opening receiving said nozzle housing, said leg opening having a first nozzle pinching edge for pinching said nozzle closed against said nozzle housing.

3. The dispensing means of claim 2 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said second tubular portion having an opening for slideably receiving said first nozzle pinching edge;

whereby when said plunger moves towards said undepressed first position, said first nozzle pinching edge passes through said opening in said second tubular portion from the exterior of said second tubular portion to the interior of said second tubular portion and first contacts and then progressively deforms said nozzle until said nozzle is pinched closed against the inside of said second tubular portion on the side opposite to said second tubular portion opening, to thereby block the dispensing of material.

4. The dispensing means of claim 3 wherein said first tubular portion comprises:

a sealing rim for sealingly retaining said first tubular potion in said first basal dispensing opening, said sealing rim having a key for engaging with a corresponding keyway in said first basal dispensing opening, said key and said keyway being configured so as to align said opening in said second tubular potion to slideably receive said first nozzle pinching edge; and wherein said second tubular portion comprises a collar for retainingly engaging said second tubular potion in said second basal dispensing opening.

5. The dispensing means of claim 3 wherein said nozzle comprises:

a first sealing rim for sealingly engaging said first tubular potion; and a second sealing rim for sealingly engaging said second tubular portion, said nozzle sealing rims being retainingly engaged by corresponding snap rings for retaining said nozzle in said first and second tubular portions.

6. The dispensing means of claim 2 wherein said first nozzle pinching edge comprises:

a wedge-shaped tang having a medial concave semi-circular portion with a convex wing on either side thereof whereby, when said plunger moves towards said undepressed first position, said concave semi-circular potion of said nozzle pinching edge first contacts and then progressively deforms said nozzle toward a crescent moon shape, with said convex wings accommodating the tips of the forming crescent moon shape, said wedge-shaped tang facilitating the deformation of said nozzle.

7. The dispensing means of claim 1 wherein said nozzle housing is rigid and tubular, said basal dispensing openings are circular, said nozzle is resilient and tubular, said arm is resilient and said arm comprises a portion having a second nozzle pinching edge for pinching said nozzle closed against said nozzle housing whereby, when said plunger is depressed from said undepressed first position to said depressed second position, said second nozzle pinching edge first pinches said nozzle closed and then progressively pinches said nozzle closed along a portion of the length of said nozzle as said plunger moves from said undepressed first position to said depressed second position; and whereby, when said second nozzle pinching edge first meets resistance from said partially tubular nozzle housing portion, said second nozzle pinching edge is deflected and said resilient arm member increasingly bends as said plunger moves from said undepressed first position to said depressed second position to facilitate the advance of said second nozzle pinching edge along said portion of the length of said nozzle.

8. The dispensing means of claim 7 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said nozzle housing configured so as to have an opening between said first tubular portion and said second tubular portion for slideably receiving said second nozzle pinching edge;

whereby, when said plunger moves from said undepressed first position towards said depressed second position, said second nozzle pinching edge passes through said opening in said nozzle housing from the exterior of said nozzle housing to the interior of said nozzle housing and first pinches said nozzle closed against said partially tubular portion of said nozzle housing and then progressively pinches said nozzle closed against a portion of the length of said partially tubular portion, to thereby urge the dispensing of material in said portion of the length of said nozzle.

9. The dispensing means of claim 8 wherein said first tubular portion comprises:

a sealing rim for sealingly retaining said first tubular portion in said first basal dispensing opening, said sealing rim having a key for engaging with a corresponding keyway in said first basal dispensing opening, said key and said keyway being configured so as to align said opening between said first tubular portion and said second tubular portion to slideably receive said second nozzle pinching edge; and wherein said second tubular portion comprises a collar for retainingly engaging said second tubular portion in said second basal dispensing opening.

10. The dispensing means of claim 8 wherein said nozzle comprises:

a first sealing rim for sealingly engaging said first tubular portion; and a second sealing rim for sealingly engaging said second tubular portion, said nozzle sealing rims being retainingly engaged by corresponding snap rings for retaining said nozzle in said first and second tubular portions.

11. The dispensing means of claim 7 wherein said second nozzle pinching edge comprises a spherical portion rollably retained on said resilient arm member whereby, when said plunger moves from said undepressed first position to said depressed second position, said free-rolling spherical potion minimizes friction as said second nozzle pinching edge advances along said potion of the length of said nozzle.

12. The dispensing means of claim 11 wherein said spherical portion comprises two hemispherical portions joined through their polar axis by an axle and configured so as to provide an essentially spherical convex pinching edge whereby, when said plunger moves towards said depressed second position, said convex pinching edge first contacts and then progressively deforms said nozzle toward a crescent moon shape, said spherical potion accommodating the tips of the crescent moon shape forming against the concave surface of the partially tubular nozzle housing portion, said spherical convex pinching edge facilitating the deformation of said nozzle.

13. The dispensing means of claim 1 wherein said nozzle housing is rigid and tubular, said basal dispensing openings are circular, said nozzle is resilient and tubular, said arm is resilient and said arm comprises a portion having a second nozzle pinching edge for pinching said nozzle closed against said nozzle housing whereby, when said plunger is depressed from said undepressed first position to said depressed second position, said second nozzle pinching edge first pinches said nozzle closed and then progressively pinches said nozzle closed along a portion of the length of said nozzle as said plunger moves from said undepressed first position to said depressed second position;

whereby, when said second nozzle pinching edge first meets resistance from said partially tubular nozzle housing portion, said second nozzle pinching edge is deflected and said resilient arm member increasingly bends as said plunger moves from said undepressed first position to said depressed second position to facilitate the advance of said second nozzle pinching edge along said portion of the length of said nozzle;

whereby, when said plunger is released and is moving from said depressed second position to said undepressed first position, said second nozzle pinching edge is pinching said nozzle closed and continues to pinch said nozzle closed along a portion of the length of said nozzle; and whereby, as said plunger moves from said depressed second position to said undepressed first position, said resilient arm member increasingly unbends to facilitate the retreat of said second nozzle pinching edge along said portion of the length of said nozzle; and whereby, when said second nozzle pinching edge finally escapes the resistance from said partially tubular nozzle housing portion, said resilient arm member returns to its undercoted state;

14. The dispensing means of claim 13 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said nozzle housing configured so as to have an opening between said first tubular portion and said second tubular portion for slideably receiving said second nozzle pinching edge;

whereby, when said plunger moves from said depressed second position towards said undepressed first position, said second nozzle pinching edge continues to pinch said nozzle closed against a portion of the length of said partially tubular portion, to thereby block the dispensing of material; and whereby, when said plunger finally reaches said undepressed first position, said second nozzle pinching edge passes through said opening in said nozzle housing from the interior of said nozzle housing to the exterior of said nozzle housing and unpinches said nozzle from said partially tubular portion of said nozzle housing, to thereby unblock the dispensing of material through said nozzle.

15. The dispensing means of claim 14 wherein said first tubular portion comprises:

a sealing rim for sealingly retaining said first tubular potion in said first basal dispensing opening, said sealing rim having a key for engaging with a corresponding keyway in said first basal dispensing opening, said key and said keyway being configured so as to align said opening between said first tubular potion and said second tubular portion to slideably receive said second nozzle pinching edge; and wherein said second tubular portion comprises a collar for retainingly engaging said second tubular portion in said second basal dispensing-opening.

16. The dispensing means of claim 14 wherein said nozzle comprises:

a first sealing rim for sealingly engaging said first tubular portion; and a second sealing rim for sealingly engaging said second tubular portion, said nozzle sealing rims being retainingly engaged by corresponding snap rings for retaining said nozzle in said first and second tubular portions.

17. The dispensing means of claim 13 wherein said second nozzle pinching edge comprises a spherical portion-rollably retained on said resilient arm member whereby, when said plunger moves from said undepressed first position to said depressed second position, said free-rolling spherical portion minimizes friction and facilitates the advance of said second nozzle pinching edge along said portion of the length of said nozzle; and whereby, when said plunger moves from said depressed second position to said undepressed first position, said free-rolling spherical portion minimizes friction and facilitates the retreat of said second nozzle pinching edge along said portion of the length of said nozzle.

18. The dispensing means of claim 17 wherein said free-rolling spherical portion comprises two hemispherical portions joined through their polar axis by an axle and configured so as to provide an essentially spherical convex pinching edge whereby, when said plunger moves towards said depressed second position, said convex pinching edge first contacts and then progressively deforms said nozzle toward a crescent moon shape, said spherical portion accommodating the tips of the crescent moon shape forming against the concave surface of the partially tubular nozzle housing portion; and whereby, when said plunger continues to be depressed and is moving from said undepressed first-position to said depressed second position, said spherical convex pinching edge of said free-rolling portion continues to deform said nozzle in a crescent moon shape with said spherical portion accommodating the tips of the crescent moon shape formed against the concave surface of the partially tubular nozzle housing portion, along a portion of the length of said nozzle, and whereby, when said plunger is released and is moving from said depressed second position to said undepressed first position, said spherical convex pinching edge of said free-rolling portion is deforming said nozzle in a crescent moon shape with said spherical portion accommodating the tips of the crescent moon shape forming against the concave surface of the partially tubular nozzle housing portion, and said spherical convex pinching edge of said free-rolling portion continues to deform said nozzle in a crescent moon shape with said spherical portion accommodating the tips of the crescent moon shape formed against the concave surface of the partially tubular nozzle housing portion, along a portion of the length of said nozzle, said spherical convex pinching edge facilitating the deformation of said nozzle.

19. The dispensing means of claim 1 wherein said slot includes at least one set screw slot for preventing the withdrawal of said slider leg from said slot and for limiting the distance said plunger can be depressed.

20. The dispensing means of claim 19 wherein said slider log includes at least one opening for slideably receiving said set screw.

21. The dispensing means of claim 1 wherein said slider leg includes side walls for guiding said slider in said slot, said side walls supposing said slider leg and configured so as to provide only slider edges and side wall ridges in sliding contact with said slot, said edges and ridges minimizing sliding friction as said plunger is moving from said undepressed first position to said depressed second position, and is returning from said depressed second position to said undepressed first position.

22. The dispensing means of claim 1 wherein said dispensing means includes a sac for containing viscous material, said sac configured, for insertion into said reservoir;

said sac having a tab extending out of said reservoir so as to be visible from the outside of said dispensing means and retained by tab retaining means whereby said tab may contain information on the contents of said sac and may assist in complete drainage and removal of said sac once spent;

said sac having a sac nozzle in fluid communication with said sac for insertion through said nozzle;

said sac nozzle having a collar for sealingly engaging said nozzle housing;

said sac nozzle having a rigid portion for threading said sac nozzle through said nozzle;

said rigid portion approximating the height of said reservoir in length;

whereby, when said rigid portion is inserted through said nozzle, said rigid portion may then be pulled through said nozzle so that said sac nozzle is threaded through said nozzle until said sac nozzle collar sealingly engages said nozzle housing; and whereby, after said sac nozzle collar has sealingly engaged said nozzle housing, said rigid portion may be separated from said sac nozzle, to thereby open said sac nozzle for dispensing said sac contents.

23. A dispensing means for a viscous material comprising:

(a) a reservoir for containing a viscous material, said reservoir having a first basal dispensing opening;

(b) an air chamber;

(c) manual pumping means actuatable to pressurize air in said air chamber, said manual pumping means comprising a manually actuatable plunger or piston and urging means to urge said plunger to an undepressed, unactuated position;

(d) venting means for venting said air chamber to ambient pressure prior to actuation of said pumping means, said venting means comprising a one-way air chamber valve for opening to allow ambient air to enter said air chamber when the pressure in said air chamber is at or below ambient pressure and for closing when the air pressure in said air chamber rises above ambient air pressure;

(e) valved duct means for communicating pressurized air from said air chamber to said reservoir via a one-way non-return valve, said duct means having a valve air inlet portion above the one-way non-return valve, said duct means incorporating said valve, and said valve having a mouth communicating with said reservoir;

said valve having a valve chamber and a reciprocatable valve element, said valve configured so as to provide a cavity between at least said valve air inlet portion and said mouth in order to trap a bubble of air in a portion of said cavity below said air inlet and above said mouth;

(f) a slot in said reservoir, said slot having a second basal dispense opening;

(g) a nozzle housing received by said first and second basal dispensing openings in communication with said reservoir;

(h) a nozzle received by said nozzle housing in fluid communication with said reservoir;

(i) a means for selectively blocking the dispensing of material through said first and second basal dispensing opening comprising:

a slider leg depending from said plunger and associated with said first and second basal dispensing openings with said leg blocking the dispensing of material when said plunger is in a first undepressed position, and said leg not blocking the dispensing of material when said plunger is depressed to a second position;

said manual plunger being operatively connected to said means for selectively blocking the dispensing of material through said first and second basal dispensing openings;

whereby ambient air in said air chamber may be pressurized in order to communicate pressurised air to said reservoir through said one-way air non-return valve so that when said reservoir contains viscous material and said nozzle is not blocked, viscous material at said second basal dispensing opening is exposed to ambient air pressure so that viscous material in said reservoir is urged to exit through said nozzle by the pressure differential between the pressure in said reservoir and ambient air pressure, and whereby repeated actuation of said pumping means may build up pressure in said reservoir due to said non-return valve and whereby air trapped below said air inlet portion and above said mouth prevents reservoir fluid fouling said valve;

(j) means for selectively urging and blocking the dispensing of material through said second basal dispensing opening comprising:

a plunger arm depending from said plunger and associated with said first and second basal dispensing openings with said arm urging the dispensing of material through said second basal dispensing opening when said plunger is depressed from said undepressed first position to said depressed second position, and with said arm not urging the dispensing of material through said second basal dispensing opening when said plunger is in said first undepressed position, or when said plunger is in said second depressed position, or when said plunger is returning from said depressed second position to said undepressed first position; and with said arm blocking the dispensing of material through said nozzle when said plunger is in said depressed second position and with said arm blocking the dispensing of material through said second basal dispensing opening during at least a portion of the return stroke of said plunger when said plunger is returning from said depressed second position to said undepressed first position;

whereby mechanical pressure exerted on said nozzle by said plunger arm when said plunger is depressed may increase pressure in said nozzle so that viscous material contained in said nozzle is urged to exit through said second basal dispensing opening by the pressure differential between the pressure in said nozzle and ambient air pressure; and whereby, after viscous material contained in said nozzle is dispensed through said second basal dispensing opening and said plunger is released and is returning from said depressed second position to said undepressed first position, the mechanical pressure exerted on said nozzle by said plunger arm may be reduced when said plunger is returning to said undepressed first position and pressure in said nozzle may fall below ambient air pressure so that material at said second basal dispensing opening may be urged by a pressure differential to re-enter said nozzle while said nozzle is not blocked by said selective blocking means; and whereby mechanical pressure is exerted on said nozzle by said plunger arm when said plunger is in said depressed second position so that said nozzle is pinched closed between said arm and said nozzle housing, thereby blocking the dispensing of viscous material through said nozzle; and whereby mechanical pressure is maintained on said nozzle by said arm when said plunger is released and is returning from said depressed second position to said undepressed first position so that said nozzle remains pinched closed between said arm and said nozzle housing during at least a portion of the return stroke of said plunger when said plunger is returning from said depressed second position to said undepressed first position, thereby blocking the dispensing of viscous material through said nozzle; and whereby viscous material contained in said reservoir may be blocked from entering said nozzle by said selective urging and blocking means when said plunger is in said depressed second position and during at least a portion of the return stroke of said plunger when said plunger is returning from said depressed second position to said undepressed first position, and free to enter said nozzle when said plunger is in said undepressed first position.

24. The dispensing means of claim 23 wherein said nozzle housing is rigid and tubular, said basal dispensing openings are circular, said nozzle is resilient and tubular, and said leg comprises an opening receiving said nozzle housing, said leg opening having a first nozzle pinching edge for pinching said nozzle closed against said nozzle housing.

25. The dispensing means of claim 24 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said second tubular portion having an opening for slideably receiving said first nozzle pinching edge;

whereby when said plunger moves towards said undepressed first position, said first nozzle pinching edge passes through said opening in said second tubular portion from the exterior of said second tubular portion to the interior of said second tubular portion and first contacts and then progressively deforms said nozzle until said nozzle is pinched closed against the inside of said second tubular portion on the side opposite to said second tubular portion opening, to thereby block the dispensing of material.

26. The dispensing means of claim 25 wherein said first tubular portion comprises:

a sealing rim for sealingly retaining said first tubular portion in said first basal dispensing opening, said sealing rim having a key for engaging with a corresponding keyway in said first basal dispensing opening, said key and said keyway being configured so as to align said opening in said second tubular portion to slideably receive said first nozzle pinching edge; and wherein said second tubular portion comprises a collar for retainingly engaging said second tubular portion in said second basal dispensing opening.

27. The dispensing means of claim 25 wherein said nozzle comprises:

a first sealing rim for sealingly engaging said first tubular portion; and a second sealing rim for sealingly engaging said second tubular portion, said nozzle sealing rims being retainingly engaged by corresponding snap rings for retaining said nozzle in said first and second tubular portions.

28. The dispensing means of claim 24 wherein said first nozzle pinching edge comprises:

a wedge-shaped tang having a medial concave semi-circular potion with a convex wing on either side thereof whereby, when said plunger moves towards said undepressed first position, said concave semi-circular potion of said nozzle pinching edge first contacts and then progressively deforms said nozzle toward a crescent moon shape, with said convex wings accommodating the tips of the forming crescent moon shape, said wedge-shaped tang facilitating the deformation of said nozzle.

29. The dispensing means of claim 23 wherein said nozzle housing is rigid and tubular, said basal dispensing openings are circular, said nozzle is resilient and tubular, said arm is resilient and said arm comprises a portion having a second nozzle pinching edge for pinching said nozzle closed against said nozzle housing whereby, when said plunger is depressed from said undepressed first position to said depressed second position, said second nozzle pinching edge first pinches said nozzle closed and then progressively pinches said nozzle closed along a portion of the length of said nozzle as said plunger moves from said undepressed first position to said depressed second position; and whereby, when said second nozzle pinching edge first meets resistance from said partially tubular nozzle housing portion, said second nozzle pinching edge is deflected and said resilient arm member increasingly bends as said plunger moves from said undepressed first position to said depressed second position to facilitate the advance of said second nozzle pinching edge along said portion of the length of said nozzle.

30. The dispensing means of claim 29 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said nozzle housing configured so as to have an opening between said first tubular portion and said second tubular portion for slideably receiving said second nozzle pinching edge;

whereby, when said plunger moves from said undepressed first position towards said depressed second position, said second nozzle pinching edge passes through said opening in said nozzle housing from the exterior of said nozzle housing to the interior of said nozzle housing and first pinches said nozzle closed against said partially tubular portion of said nozzle housing and then progressively pinches said nozzle closed against a portion of the length of said partially tubular portion, to thereby urge the dispensing of material in said portion of the length of said nozzle.

31. The dispensing means of claim 30 wherein said first tubular portion comprises:

a sealing rim for sealingly retaining said first tubular portion in said first basal dispensing opening, said sealing rim having a key for engaging with a corresponding keyway in said first basal dispensing opening, said key and said keyway being configured so as to align said opening between said first tubular portion and said second tubular portion to slideably receive said second nozzle pinching edge; and wherein said second tubular portion comprises a collar for retainingly engaging said second tubular portion in said second basal dispensing opening.

32. The dispensing means of claim 30 wherein said nozzle comprises:

a first sealing rim for sealingly engaging said first tubular portion; and a second sealing rim for sealingly engaging said second tubular portion, said nozzle sealing rims being retainingly engaged by corresponding snap rings for retaining said nozzle in said first and second-tubular portions.

33. The dispensing means of claim 29 wherein said second nozzle pinching edge comprises a spherical portion rollably retained on said resilient arm member whereby, when said plunger moves from said undepressed first position to said depressed second position, said free-rolling spherical portion minimizes friction as said second nozzle pinching edge advances along said portion of the length of said nozzle.

34. The dispensing means of claim 33 wherein said spherical portion comprises two hemispherical portions joined through their polar axis by an axle and configured so as to provide an essentially spherical convex pinching edge whereby, when said plunger moves towards said depressed second position, said convex pinching edge first contacts and then progressively deforms said nozzle toward a crescent moon shape, said spherical portion accommodating the tips of the crescent moon shape forming against the concave surface of the partially tubular nozzle housing portion, said spherical convex pinching edge facilitating the deformation of said nozzle.

35. The dispensing means of claim 23 wherein said nozzle housing is rigid and tubular, said basal dispensing openings are circular, said nozzle is resilient and tubular, said arm is resilient and said arm comprises a portion having a second nozzle pinching edge for pinching said nozzle closed against said nozzle housing whereby, when said plunger is depressed from said undepressed first position to said depressed second position, said second nozzle pinching edge first pinches said nozzle closed and then progressively pinches said nozzle closed along a portion of the length of said nozzle as said plunger moves from said undepressed first position to said depressed second position;

whereby, when said second nozzle pinching edge first meets resistance from said partially tubular nozzle housing portion, said second nozzle pinching edge is deflected and said resilient arm member increasingly bends as said plunger moves from said undepressed first position to said depressed second position to facilitate the advance of said second nozzle pinching edge along said portion of the length of said nozzle;

whereby, when said plunger is released and is moving from said depressed second position to said undepressed first position, said second nozzle pinching edge is pinching said nozzle closed and continues to pinch said nozzle closed along a portion of the length of said nozzle; and whereby, as said plunger moves from said depressed second position to said undepressed first position, said resilient arm member increasingly unbends to facilitate the retreat of said second nozzle pinching edge along said portion of the length of said nozzle; and whereby, when said second nozzle pinching edge finally loses resistance from said partially tubular nozzle housing portion, said resilient arm member returns to its undeflected state;

36. The dispensing means of claim 35 wherein said nozzle housing comprises:

(a) a first tubular portion received by said first basal dispensing opening in communication with said reservoir;

(b) a second tubular portion received by said second basal dispensing opening in said slot; and (c) a partially tubular portion joining said first tubular portion and said second tubular portion;

said nozzle housing configured so as to have an opening between said first tubular portion and said second tubular portion for slideably receiving said second nozzle pinching edge;

whereby, when said plunger moves from said depressed second position towards said undepressed first position, said second nozzle pinching edge continues to pinch said nozzle closed against a portion of the length of said partially tubular portion, to thereby block the dispensing of material; and whereby, when said plunger finally reaches said undepressed first position, said second nozzle pinching edge passes through said opening in said nozzle housing from the interior of said nozzle housing to the exterior of said nozzle housing and unpinches said nozzle from said partially-tubular portion of said nozzle housing, to thereby unblock the dispensing of material through said nozzle.

37. The dispensing means of claim 36 wherein said first tubular portion comprises:

a sealing rim for sealingly retaining said first tubular portion in said first basal dispensing opening, said sealing rim having a key for engaging with a corresponding keyway in said first basal dispensing opening, said key and said keyway being configured so as to align said opening between said first tubular portion and said second tubular portion to slideably receive said second nozzle pinching edge; and wherein said second tubular portion comprises a collar for retainingly engaging said second tubular portion in said second basal dispensing opening.

38. The dispensing means of claim 36 wherein said nozzle comprises:

a first sealing rim for sealingly engaging said first tubular portion; and a second sealing rim for sealingly engaging said second tubular portion, said nozzle sealing rims being retainingly engaged by corresponding snap rings for retaining said nozzle in said first and second tubular portions.

39. The dispensing means of claim 35 wherein said second nozzle pinching edge comprises a spherical portion rollably retained on said resilient arm member whereby, when said plunger moves from said undepressed first position to said depressed second position, said free-rolling spherical portion minimizes friction and facilitates the advance of said second nozzle pinching edge along said portion of the length of said nozzle; and whereby, when said plunger moves from said depressed second position to said undepressed first position, said free-rolling spherical portion minimizes friction and facilitates the retreat of said second nozzle pinching edge along said portion of the length of said nozzle.

40. The dispensing means of claim 39 wherein said free-rolling spherical portion comprises two hemispherical portions joined through their polar axis by an axle and configured so as to provide an essentially spherical convex pinching edge whereby, when said plunger moves towards said depressed second position, said convex pinching edge first contacts and then progressively deforms said nozzle toward a crescent moon shape, said spherical portion accommodating the tips of the crescent moon shape forming against the concave surface of the partially tubular nozzle housing portion; and whereby, when said plunger continues to be depressed and is moving from said undepressed first position to said depressed second position, said spherical convex pinching edge of said free-rolling portion continues to deform said nozzle in a crescent moon shape with said spherical portion accommodating the tips of the crescent moon shape formed against the concave surface of the partially tubular nozzle housing portion, along a portion of the length of said nozzle, and whereby, when said plunger is released and is moving from said depressed second position to said undepressed first position, said spherical convex pinching edge of said free-rolling portion is deforming said nozzle in a crescent moon shape with said spherical portion accommodating the tips of the crescent moon shape forming against the concave surface of the partially tubular nozzle housing portion, and said spherical convex pinching edge of said free-rolling portion continues to deform said nozzle in a crescent moon shape with said spherical portion accommodating the tips of the crescent moon shape formed against the concave surface of the partially tubular nozzle housing portion, along a portion of the length of said nozzle, said spherical convex pinching edge facilitating the deformation of said nozzle.

41. The dispensing means of claim 23 wherein said slot includes at least one set screw for preventing the withdrawal of said slider leg from said slot and for limiting the distance said plunger can be depressed.

42. The dispensing means of claim 41 wherein said slider leg includes at least one opening for slideably receiving said set screw.

43. The dispensing means of claim 23 wherein said slider leg includes side walls for guiding said slider in said slot, said side walls supporting said slider leg and configured so as to provide only slider edges and side wall ridges in sliding contact with said slot, said edges and ridges minimizing sliding friction as said plunger is moving from said undepressed first position to said depressed second position, and is returning from said depressed second position to said undepressed first position.

44. The dispensing means of claim 23 wherein said dispensing means includes a sat for containing viscous material, said sac configured for insertion into said reservoir;

said sac having a tab extending out of said reservoir so as to be visible from the outside of said dispensing means and retained by tab retaining means whereby said tab may contain information on the contents of said sac and may assist in complete drainage and removal of said sac once spent;

said sac having a sac nozzle in fluid communication with said sac for insertion through said nozzle;

said sac nozzle having a collar for sealingly engaging said nozzle housing;

said sac nozzle having a rigid portion for threading said sac nozzle through said nozzle;

said rigid extension approximating the height of said reservoir in length;

whereby, when said rigid extension is inserted through said nozzle, said rigid portion may then be pulled through said nozzle so that said sac nozzle is threaded through said nozzle until said sac nozzle collar sealingly engages said nozzle housing; and whereby, after said sac nozzle collar has sealingly engaged said nozzle housing, said rigid portion may be separated from said sac nozzle, to thereby open said sac nozzle for dispensing said sac contents.

45. The dispensing means of claim 23 wherein said reservoir comprises a sloping wall configured so as to provide an air space between said valve mouth communicating with said reservoir and a sac contained in said reservoir whereby, when said plunger is depressed, ambient air in said air chamber may be pressurized in order to communicate pressurized air to said reservoir through said one-way air non-return valve so that when said reservoir contains a sac of viscous material and said valve mouth is not blocked, pressurized air is free to flow into said air space so that said sac of viscous material at said air space is exposed to increased air pressure so that viscous material in said sac is urged to exit through said nozzle by the pressure differential between the pressure in said reservoir and ambient air pressure;

whereby repeated actuation of said pumping means may build up pressure in said reservoir due to said non-return valve and said air space between said mouth and said sac; and whereby said air space between said mouth and said sac prevents the sac blocking said valve.

* * * * *